US010569537B2

(12) United States Patent
Horade et al.

(10) Patent No.: US 10,569,537 B2
(45) Date of Patent: Feb. 25, 2020

(54) LIQUID DISCHARGE APPARATUS

(71) Applicant: BROTHER KOGYO KABUSHIKI KAISHA, Nagoya-shi, Aichi-ken (JP)

(72) Inventors: Kenta Horade, Toukai (JP); Mikio Ogawa, Nagoya (JP); Toshiro Ueda, Inazawa (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/507,557

(22) Filed: Jul. 10, 2019

(65) Prior Publication Data

US 2019/0329547 A1 Oct. 31, 2019

Related U.S. Application Data

(63) Continuation of application No. 15/937,951, filed on Mar. 28, 2018, now Pat. No. 10,399,333.

(30) Foreign Application Priority Data

Mar. 31, 2017 (JP) ..... 2017-072167

(51) Int. Cl.
*B41J 2/175* (2006.01)
*B41J 2/045* (2006.01)
(Continued)

(52) U.S. Cl.
CPC ..... *B41J 2/04586* (2013.01); *B41J 2/1752* (2013.01); *B41J 2/17509* (2013.01);
(Continued)

(58) Field of Classification Search
CPC ..... B41J 2/17566; B41J 2/175; B41J 2002/17569; B41J 2002/17576; B41J 2002/17589
See application file for complete search history.

(56) References Cited

U.S. PATENT DOCUMENTS 6,866,355 B2 3/2005 Aruga et al.
2007/0008351 A1 1/2007 Teshigawara et al.
(Continued)

FOREIGN PATENT DOCUMENTS

JP 2008-213162 A 9/2008
JP 5164570 B2 3/2013

OTHER PUBLICATIONS

Office Action dated Sep. 27, 2019 received in U.S. Appl. No. 16/156,095.

*Primary Examiner* — Scott A Richmond
(74) *Attorney, Agent, or Firm* — Scully, Scott, Murphy & Presser, P.C.

(57) ABSTRACT

An apparatus, for discharging a liquid through a head based on a first discharge instruction, is configured to: update a liquid amount V stored in the memory with a value equivalent to the amount of liquid instructed to be discharged by the first discharge instruction; determine whether the updated liquid amount V is equal to or larger a threshold amount; update the liquid amount V stored in a memory to a predetermined value in response to determining that the updated liquid amount V is equal to or larger than the threshold amount and receiving a second signal from the liquid level sensor; and prohibit the liquid from being discharged through the head in response to determining that the updated liquid amount V is less than the threshold amount and receiving the first signal from the liquid level sensor.

15 Claims, 13 Drawing Sheets

(51) Int. Cl.
*B41J 29/13* (2006.01)
*B41J 29/38* (2006.01)

(52) U.S. Cl.
CPC ..... *B41J 2/17523* (2013.01); *B41J 2/17546* (2013.01); *B41J 2/17553* (2013.01); *B41J 2/17566* (2013.01); *B41J 29/13* (2013.01); *B41J 29/38* (2013.01); *B41J 2002/17569* (2013.01); *B41J 2002/17589* (2013.01)

(56) References Cited

U.S. PATENT DOCUMENTS

| | | | | |
|---|---|---|---|---|
| 2008/0204488 | A1 | 8/2008 | Usui | |
| 2008/0231676 | A1* | 9/2008 | Shimizu | B41J 2/17513 347/86 |
| 2016/0059570 | A1* | 3/2016 | Kobayashi | B41J 2/17523 347/86 |
| 2016/0059571 | A1* | 3/2016 | Kobayashi | B41J 2/17513 347/7 |

* cited by examiner

LIQUID DISCHARGE APPARATUS

CROSS-REFERENCE TO RELATED APPLICATIONS

This application is a continuation application of U.S. application Ser. No. 15/937,951 filed on Mar. 28, 2018, which claims priority from Japanese Patent Application No. 2017-072167 filed on Mar. 31, 2017, the entire subject matters of which is incorporated herein by reference.

TECHNICAL FIELD

The present disclosure relates to a liquid discharge apparatus for discharging a liquid.

BACKGROUND

From the related art, an inkjet printer including a detachable main tank, a sub tank, an image recording unit, and a residual amount detection sensor is known (for example, JP-A-2008-213162). When the main tank is mounted on the inkjet printer, some of the ink stored in the main tank moves to the sub tank. The image recording unit discharges the ink stored in the sub tank. The residual amount detection sensor detects the residual amount of the ink stored in the main tank. The inkjet printer prohibits the image recording unit from discharging the ink when the residual amount detection sensor detects that the residual amount of the ink is less than a threshold.

However, if the residual amount detection sensor malfunctions, the inkjet printer can hardly grasp the residual amount of the ink. In this case, the inkjet printer may continuously discharge the ink through the image recording unit despite the fact that an actual residual amount of the ink is less than the threshold. Then, there are problems that air enters a flow path of the ink extending from the sub tank to the image recording unit (so-called "air-in") and an image recording quality deteriorates.

SUMMARY

The present disclosure has been made in view of the above circumstances, and one of objects of the present disclosure is to provide a liquid discharge apparatus in which a cartridge including a first liquid chamber for storing a liquid is installed and a technique capable of effectively preventing air-in in a liquid discharge apparatus including a second liquid chamber.

According to an illustrative embodiment of the present disclosure, there is provided a liquid discharge apparatus, which discharges a liquid through a head based on a first discharge instruction. The liquid discharge apparatus is configured to update a liquid amount V stored in the memory with a value equivalent to the amount of liquid instructed to be discharged by the first discharge instruction; determine whether the updated liquid amount V is equal to or larger a threshold amount; update the liquid amount V stored in a memory to a predetermined value in response to determining that the updated liquid amount V is equal to or larger than the threshold amount and receiving a second signal from the liquid level sensor; and prohibit the liquid from being discharged through the head in response to determining that the updated liquid amount V is less than the threshold amount and receiving the first signal from the liquid level sensor.

DETAILED DESCRIPTION

Figure 1A:
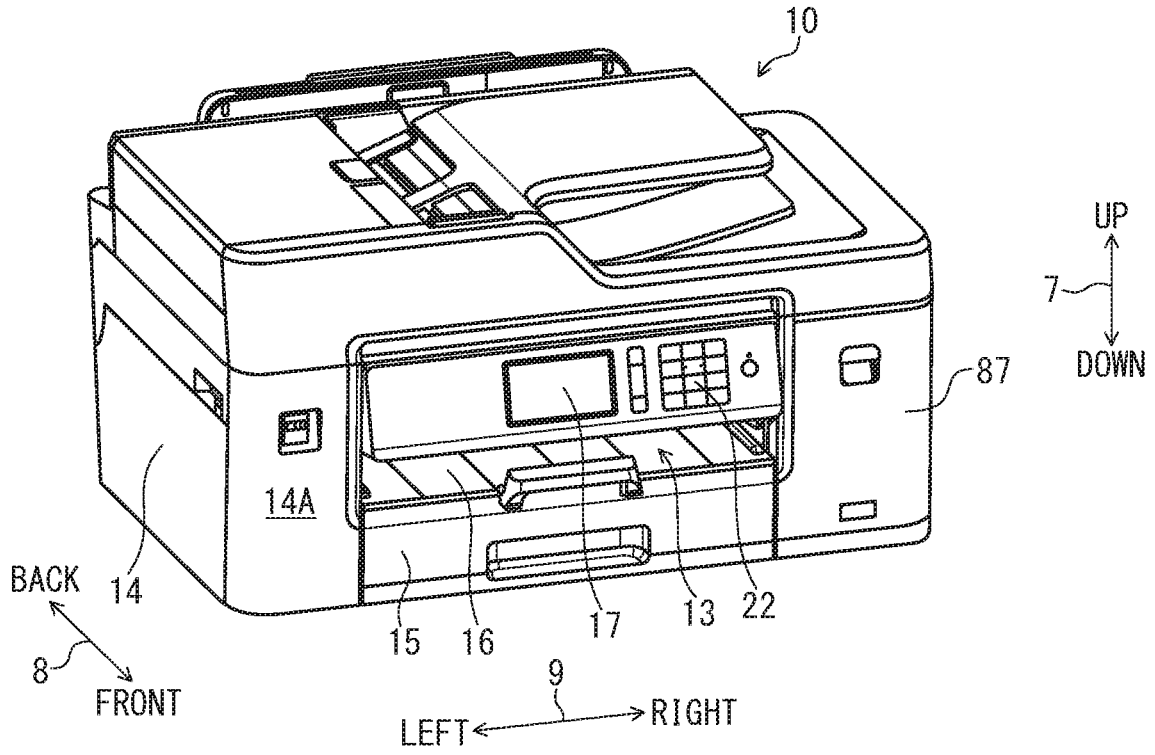
FIG. 1A is an external perspective view of a printer and illustrates a state where a cover is in a covering position.

An embodiment according to the present disclosure will be described below. It is noted that the embodiment described below is merely an example of the present disclosure and can be appropriately modified without departing from the spirit of the present disclosure. In this disclosure, an up and down direction 7 is defined with reference to a posture of a printer 10 installed in a horizontal plane in a usable manner, a front and rear direction 8 is defined with a surface on which an opening 13 of the printer 10 is formed as a front surface, and a left and right direction 9 is defined when viewing the printer 10 from the front surface. In the embodiment, the up and down direction 7 in the use posture corresponds to a vertical direction, and the front and rear direction 8 and the left and right direction 9 correspond to a horizontal direction. The front and rear direction 8 and the left and right direction 9 are orthogonal to each other.

[Outline of Printer 10]

The printer 10 according to the embodiment is an example of a liquid discharge apparatus that records an image on a sheet using an inkjet recording method. The printer 10 has a housing 14 having substantially rectangular parallelepiped shape. Further, the printer 10 may be a so-called "multi-function device" having a facsimile function, a scan function, and a copy function.

Figure 1B:
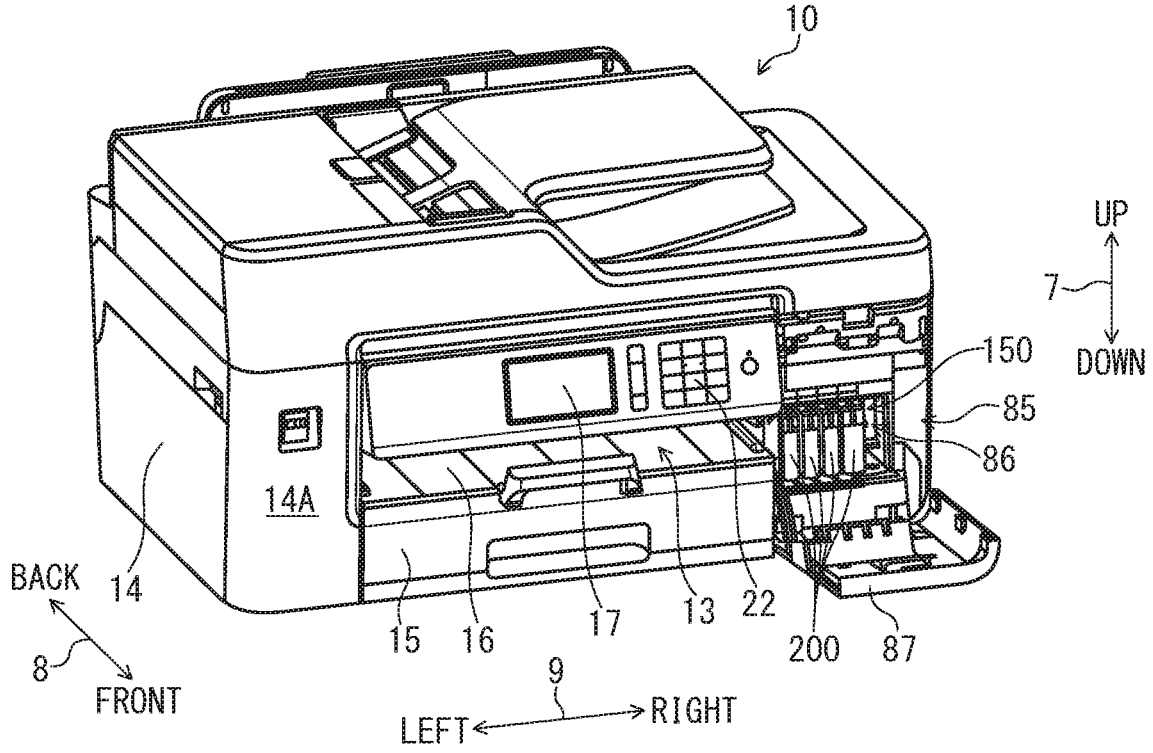
FIG. 1B is an external perspective view of the printer and illustrates a state where the cover is in an exposing position.
Figure 2:
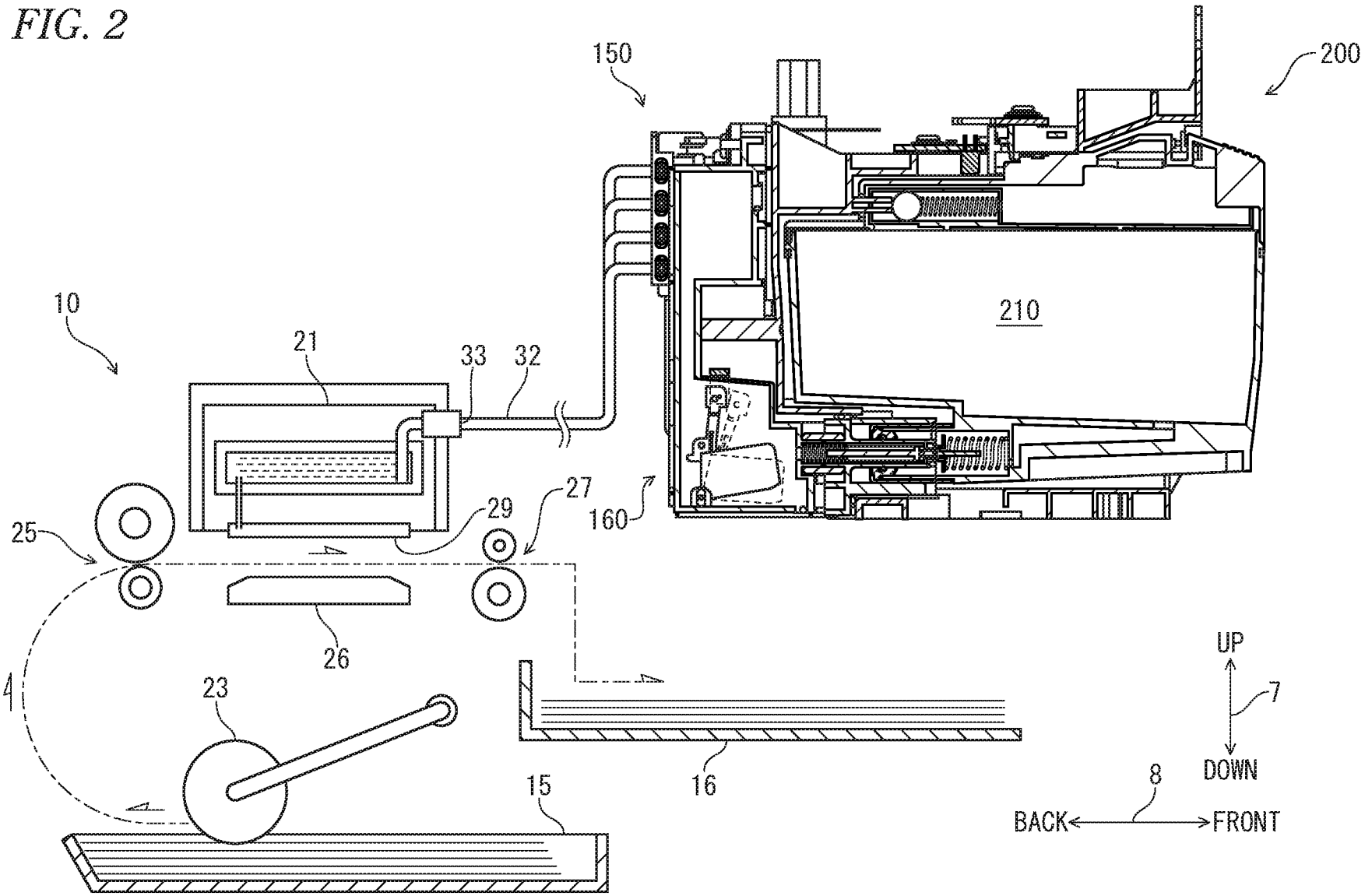
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

The head 21 may be mounted on a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

[Cover 87]

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads rearwards from the opening 85.

[Cover Sensor 88]

Figure 6:
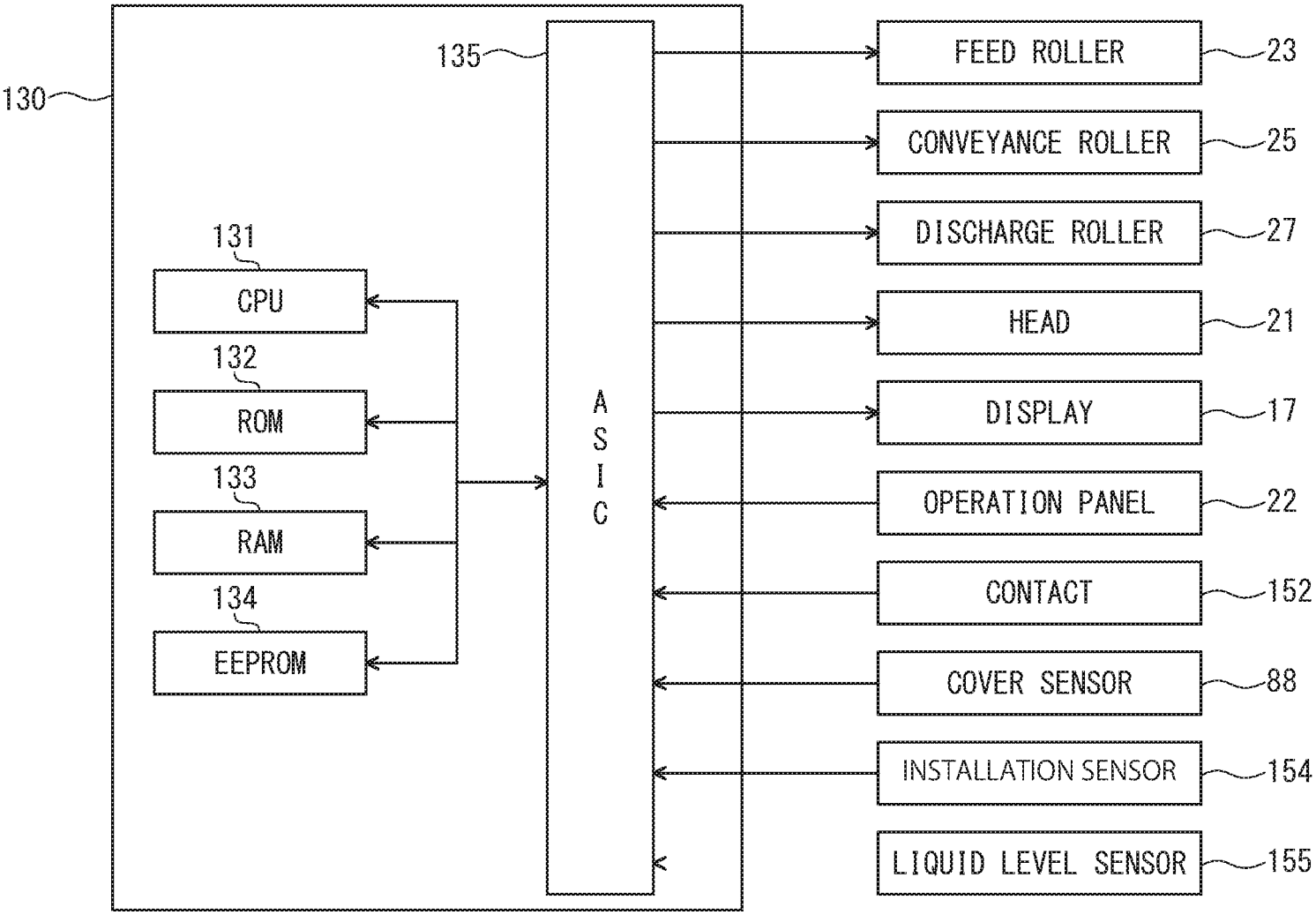
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal strength than the low-level signal to the controller 130 when the cover 87 is located at a position different from the covering position. In other words, the cover sensor 88 outputs the high-level signal to the controller 130 when the cover 87 is located at the exposing position.

[Installation Case 150]

Figure 3:
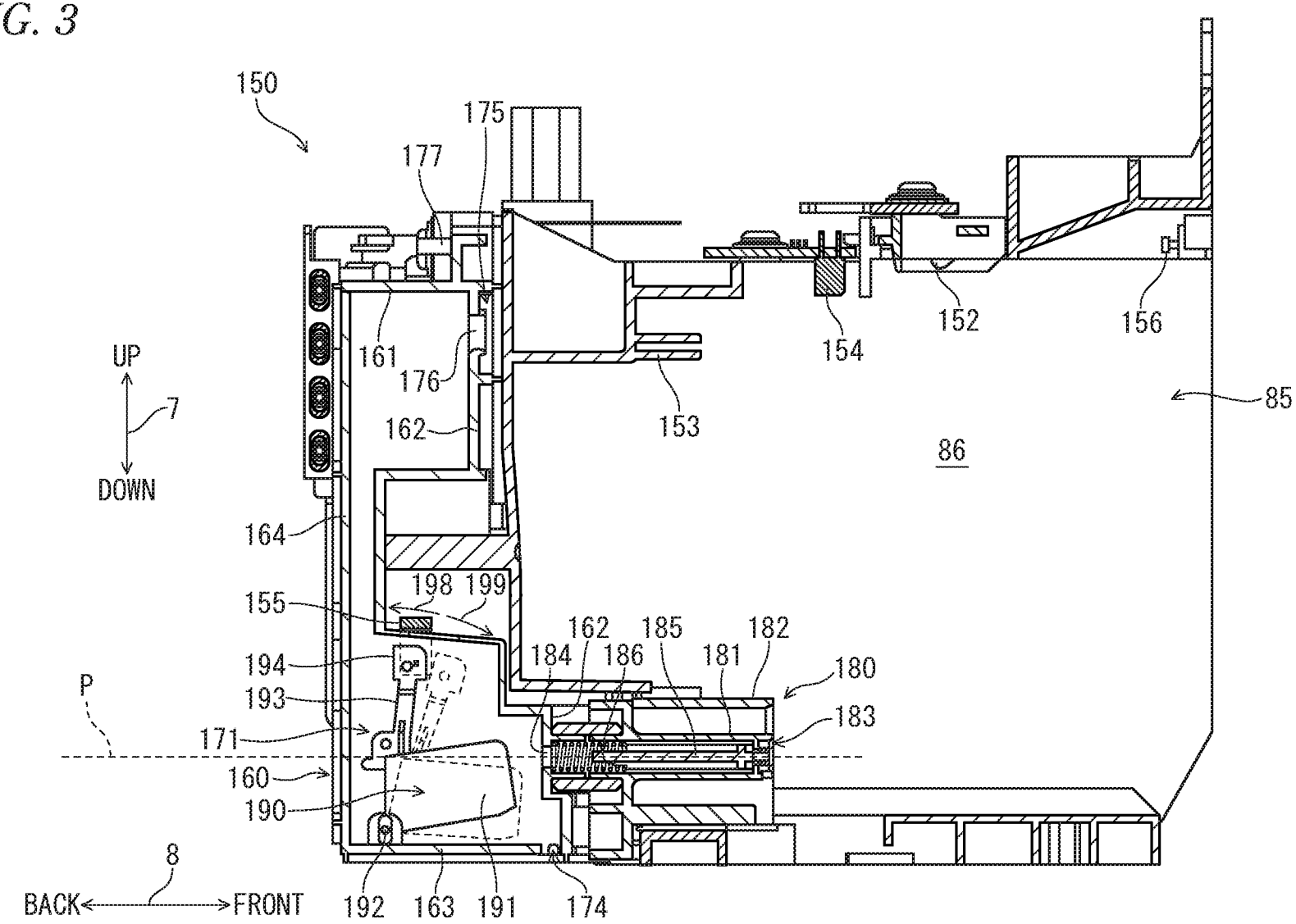
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be installed.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and rear direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes rearwards through the opening 85 in the front and rear direction 8, and is installed in the installation case 150. The cartridge 200 pulled out of the installation case 150 passes forward through the opening 85 in the front and rear direction 8.

[Contact 152]

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

[Rod 153]

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 in the installation case 150. When the rod 153 enters the air valve chamber 214, the air valve chamber 214 to be described below communicates with the air.

[Installation Sensor 154]

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal to the controller when an intensity of the light received by the light receiving portion is lower than a threshold intensity, for example. Meanwhile, the installation sensor 154 outputs a high-level signal having higher signal strength than the low-level signal to the controller 130 when the intensity of the light received by the light receiving portion is equal to or higher than the threshold intensity. The high-level signal is an example of a third signal, and the low-level signal is an example of a fourth signal.

[Liquid Level Sensor 155]

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion.

[Lock Pin 156]

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at an installation position illustrated in FIG. 5. The cartridge 200 is engaged with the lock pin 156 in a state of being installed in the installation case 150.

[Tank 160]

The printer 10 includes four tanks 160 corresponding to four cartridges 200. The tank 160 is located rearwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and rear direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through hole 184) in the up and down direction 7. The ink flow path (not illustrated) communicating with the outflow port 174 communicates with the tube 32. Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a fourth flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through hole 176 penetrating the front wall 162. In addition, the air communication chamber 175 communicates with the outside of the printer 10 through an air communication port 177 and a tube (not illustrated) connected to the air communication port 177. That is, the air communication chamber 175 is an example of a fifth flow path in which one end (through hole 176) communicates with the liquid chamber 171 and the other end (air communication port 177) communicates with the outside of the printer 10. The air communication chamber 175 communicates with the air through the air communication port 177 and the tube (not illustrated).

[Joint 180]

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through hole 184 penetrating the front wall 162. The needle 181 is an example of a third flow path in which one end (opening 183) communicates with the outside of the tank 160 and the other end (through hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an open position in the front and rear direction 8. The valve 185 closes the opening 183 when being positioned at the closed position. Further, the valve 185 opens the opening 183 when being located at the open position. The coil spring 186 urges forward the valve 185 in a moving direction from the open position to the closed position, that is, the front and rear direction 8.

[Actuator 190]

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and rear direction 8. The detection target portion 194 is formed of a material or color that shields the light output from the light emitting portion of the liquid level sensor 155.

When a liquid level of the ink stored in the liquid chamber 171 is equal to or higher than a boundary position P, the actuator 190 rotated in the direction of the arrow 198 by buoyancy is held at the detection position indicated by the solid line in FIG. 3, by the stopper. On the other hand, when the liquid level of the ink is lower than the boundary position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The boundary position P has the same height as an axial center of the needle 181 in the up and down direction 7, and has the same height as a center of an ink supply port 234 (to be described below). However, the boundary position P is not limited to the position as long as it is located above the outflow port 174 in the up and down direction 7. As another example, the boundary position P may be a height of the upper end or the lower end of the internal space of the needle 181, or may be a height of an upper end or a lower end of the ink supply port 234.

When the liquid level of the ink stored in the liquid chamber 171 is equal to or higher than the boundary position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the boundary position P, since the light output from the light emitting portion reaches the light receiving portion, the liquid level sensor 155 outputs a high-level signal to the controller 130. The low-level signal is an example of a first signal, and the high-level signal is an example of a second signal. That is, the controller 130 can detect from the signal output from the liquid level sensor 155 whether the liquid level of the ink stored in the liquid chamber 171 is equal to or higher than the boundary position P.

[Cartridge 200]

Figure 4A:
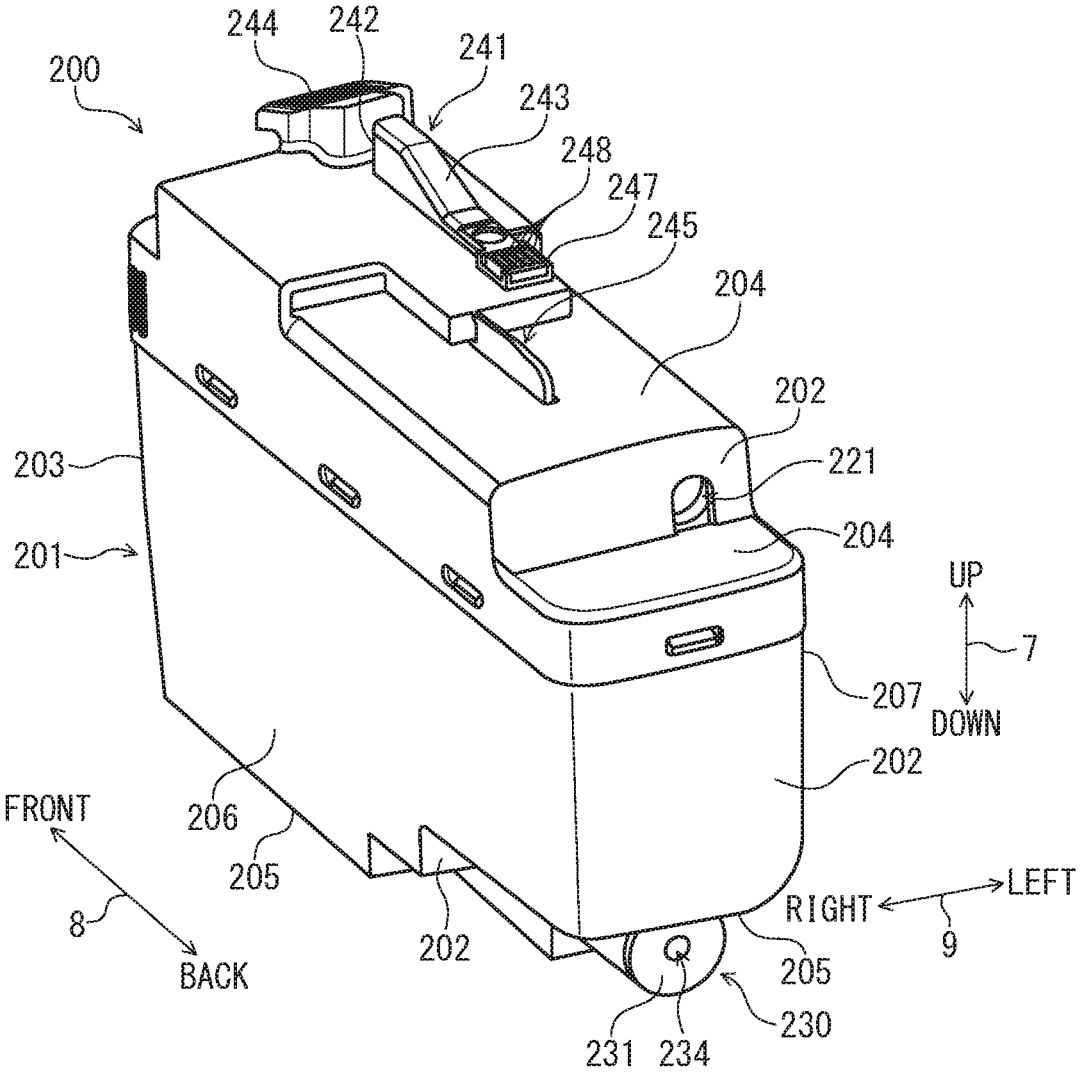
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and rear direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and rear direction 8. In addition, the upper wall 204 includes a plurality of walls that deviate from each other in the up and down direction 7. Further, the lower wall 205 includes a plurality of walls that deviate from each other in the up and down direction 7.

Figure 4B:
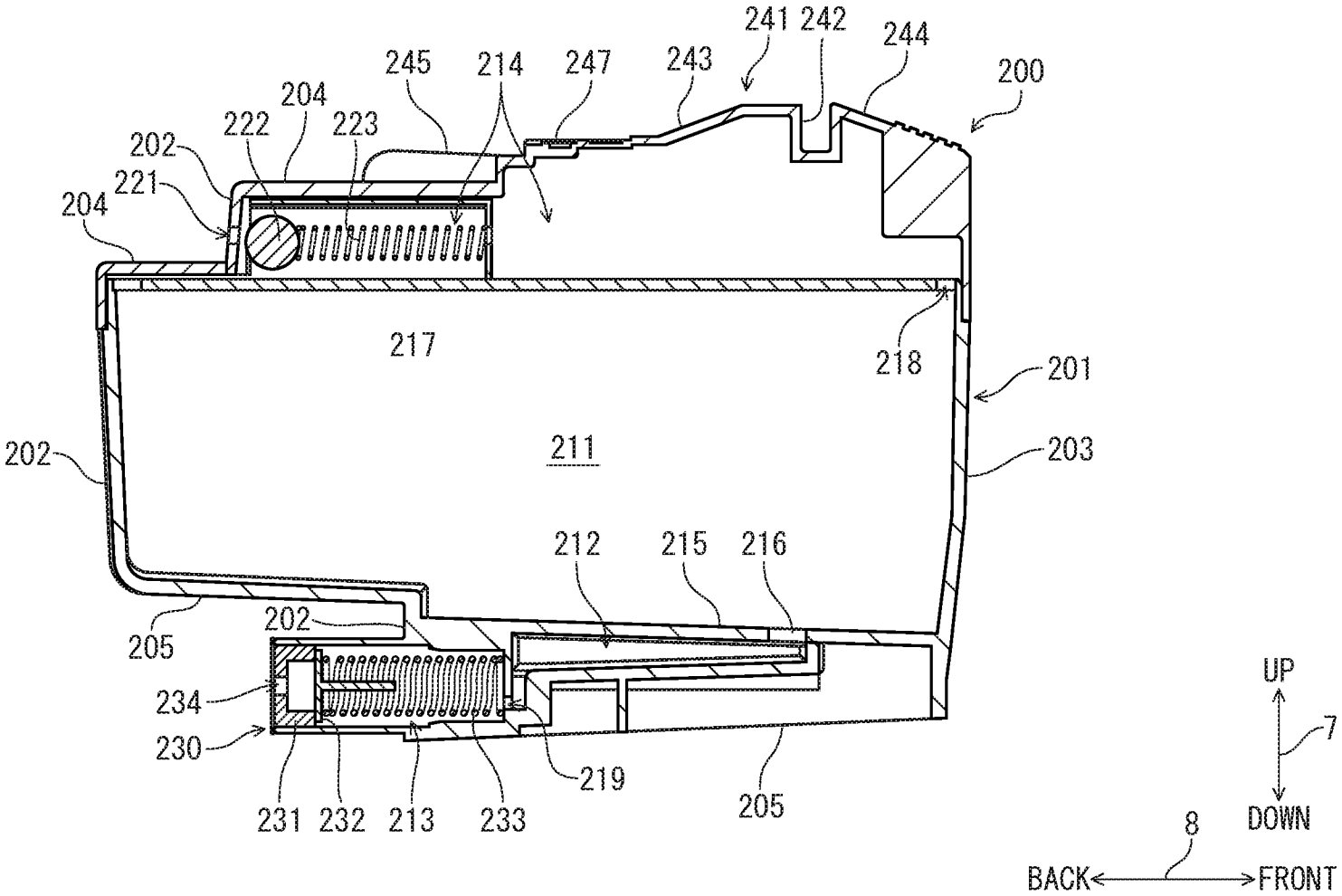
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed.

The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through hole 218 formed in the partition wall 217. Further, the ink valve chamber 213 communicates with a lower end of the lower liquid chamber 212 through a through hole 219.

The air valve chamber 214 communicates with the outside of the cartridge 200 through the air communication port 221 formed in the rear wall 202 at the upper part of the cartridge 200. That is, the air valve chamber 214 is an example of a second flow path in which one end (through hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an open position in the front and rear direction 8. When being located at the closed position, the valve 222 closes the air communication port 221. Further, when being located at the open position, the valve 222 opens the air communication port 221. The coil spring 223 urges backward the valve 222 in a moving direction from the open position to the closed position, that is, the front and rear direction 8.

The rod 153 enters the air valve chamber 214 through the air communication port 221 in the course of installing the cartridge 200 in the installation case 150. The rod 153 having entered the air valve chamber 214 moves forward the valve 222 located at the closed position against an urging force of the coil spring 223. Then, as the valve 222 moves to the open position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through hole 219 and the outside of the cartridge 200 to communicate with each other. The ink valve chamber 213 is an example of a first flow path in which one end (through hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and rear direction 8 is formed. An inner diameter of the ink supply port 234 is slightly smaller than an outer diameter of the needle 181. The valve 232 is movable between a closed position and an open position in the front and rear direction 8. When being located at the closed position, the valve 232 comes in contact with the packing 231 and closes the ink supply port 234. Further, when being located at the open position, the valve 232 separates from the packing 231 and opens the ink supply port 234. The coil spring 233 urges backward the valve 232 in a moving direction from the open position to the closed position, that is, the front and rear direction 8. In addition, the urging force of the coil spring 233 is larger than that of the coil spring 186.

The supply tube 230 enters the guide 182 in the course of installing the cartridge 200 in the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
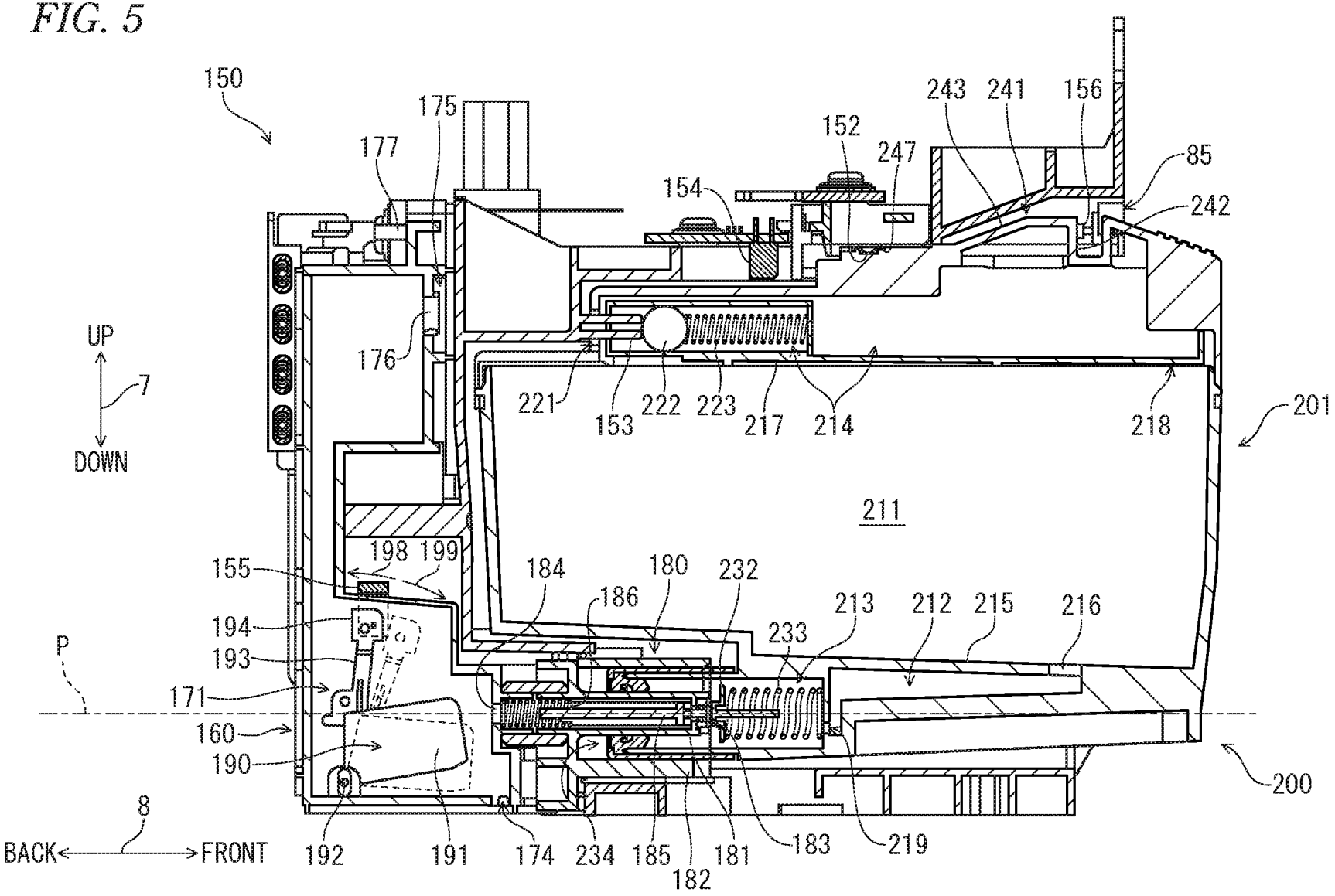
FIG. 5 is a longitudinal sectional view illustrating a state where the cartridge is installed in the installation case 150.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference, which is a difference in liquid height level, through the connected supply tube 230 and the joint 180.

A projection 241 is formed on the upper wall 204. The projection 241 protrudes upward from the outer surface of the upper wall 204 and extends in the front and rear direction 8. The projection 241 includes a lock surface 242 and an inclined surface 243. The lock surface 242 and the inclined surface 243 are located above the upper wall 204. The lock surface 242 is directed to the front side in the front and rear direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and rear direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 in the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and rear direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC chip 247 is located on the outer surface of the upper wall 204 and between the light shielding rib 245 and the projection 241 in the front and rear direction 8. On the IC chip 247, an electrode 248 is formed. In addition, the IC chip 247 includes a memory (not illustrated). The electrode 248 is electrically connected to the memory of the IC chip 247. The electrode 248 is exposed on an upper surface of the IC chip 247 so as to be electrically connectable with the contact 152. That is, the electrode 248 is electrically connected to the contact 152 in the state where the cartridge 200 is installed in the installation case 150. The controller 130 can read information from the memory of the IC chip 247 through the contact 152 and the electrode 248, and can write information to the memory of the IC chip 247 through the contact 152 and the electrode 248.

Incidentally, the interface of the installation case 150 may be configured by a wireless interface, and the IC chip 247 may be formed with a wireless interface. The wireless interface of the IC chip 247 may be electrically connected to the memory of the IC chip 247. The wireless interface of the IC chip 247 may be communicatable with the wireless interface of the installation case 150 wirelessly, in the state where the cartridge 200 is installed in the installation case 150, for example. The controller 130 may read-out/write information from/to the memory of the IC chip 247 via the wireless interface of the IC chip 247 and the wireless interface of the installation case 150.

The memory of the IC chip 247 stores the maximum ink amount Vc0, viscosity ρ, the ink amount Vc, a height Hc, a flow path resistance Rc, and a function Fc which will be described below. The memory of the IC chip 247 is an example of a cartridge memory. The maximum ink amount Vc0 is an example of the maximum liquid amount indicating the maximum amount of ink that can be stored in the cartridge 200. In other words, the ink amount Vc0 indicates the amount of ink stored in a new cartridge 200. The viscosity p indicates viscosity of the ink stored in the cartridge 20X). Hereinafter, information stored in the memory of the IC chip 247 may be collectively referred to as "CTG information" in some cases. Further, the "new" indicates a state in which the ink stored in the cartridge 200 has never flowed out from the cartridge 200.

A storage region of the memory of the IC chip 247 includes, for example, a first region, a second region, and a third region. The first region, the second region, and the third region are mutually different memory region. The first region and the third region are regions where information is not overwritten by the controller 130. Meanwhile, the second region is a region where information can be overwritten by the controller 130. Then, the first region stores the flow path resistance Rc and the function Fc, the second region stores the ink amount Vc and the height Hc, and the third region stores the maximum liquid amount Vc0.

[Controller 130]

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of device memories.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

A display 17 and an operation panel 22 are connected to the ASIC 135. The display 17 is a liquid crystal display, an organic EL display, or the like, and includes a display screen on which various types of information are displayed. The display 17 is an example of a notification device. However, specific examples of the notification device are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display.

The ASIC 135 is connected with the contact 152, the cover sensor 88, the installation sensor 154, and the liquid level sensor 155. The controller 130 accesses the memory of the IC chip 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the boundary position P.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, the maximum ink amount Vc0, heights Hc and Hs, flow path resistances Rc, Rs, and Rn, functions Fc and Fs, a C_Empty flag, an S_Empty flag, and a count value N.

The maximum ink amount Vc0, the ink amount Vc, the height Hc, the flow path resistance Rc, and the function Fc are information which are read from the memory of the IC chip 247 through the contact 152 by the controller 130 in the state where the cartridge 200 is installed in the installation case 150. In addition, the flow path resistances Rc and Rn and the function Fs may be stored in the ROM 132 instead of the EEPROM 134.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by Equations 3 and 4 to be described below, for example.

The height Hc indicates a height in the up and down direction between the liquid level of the ink stored in the cartridge 200 and a reference position. The height Hs indicates a height in the up and down direction between the liquid level of the ink stored in the tank 160 and the reference position. As an example, the reference position may be a position of an imaginary line passing through the center of the internal space of the needle 181 and extending along the horizontal direction (more specifically, the front and rear direction 8). As another example, the reference position may be the same position as the boundary position P. The heights Hc and Hs are calculated by Equations 5 and 6, for example.

The flow path resistance Rc indicates the magnitude of resistance applied to the air passing through the air valve chamber 214. More specifically, the flow path resistance Rc indicates resistance when air passes through a semipermeable membrane located in the flow path extending from the air communication port 221 to the through hole 218. The flow path resistance Rs indicates the magnitude of resistance applied to air passing through the air communication chamber 175. More specifically, the flow path resistance Rs indicates resistance when air passes through a semipermeable membrane located in the flow path extending from the air communication port 177 to the through hole 176. The flow path resistance Ra indicates the magnitude of resistance applied to the ink passing through the ink valve chamber 213 and the internal space of the needle 181 which communicate with each other. More specifically, the flow path resistance Ra indicates one or both of the magnitude of the resistance applied to the ink passing through the ink valve chamber 213 and the magnitude of the resistance applied to the ink passing through the internal space of the needle 181.

The function Fc is an example of first corresponding information indicating a corresponding relation between the ink amount Vc and the height Hc. When a horizontal sectional area Dc of the liquid chamber 210 of the cartridge 200 varies in the up and down direction 7, the function Fc is predetermined in designing the cartridge 200, with the ink amount Vc and the height Hc as variables. Meanwhile, when the horizontal sectional area Dc is constant in the up and down direction 7, a relation of "function Fc=Vc/Dc" is established. The first corresponding information is not limited to the form of a function but may be in the form of a table including a plurality of sets of ink amount Vc and height Hc corresponding to each other.

The function Fs is an example of second corresponding information indicating a corresponding relation between the ink amount Vs and the height Hs. When a horizontal sectional area Ds of the liquid chamber 171 of the tank 160 varies in the up and down direction 7, the function Fs is predetermined in designing the tank 160, with the ink amount Vs and the height Hs as variables. Meanwhile, when the horizontal sectional area Ds is constant in the up and down direction 7, a relation of"function Fs=Vs/Ds" is established. The second corresponding information is not limited to the form of a function but may be in the form of a table including a plurality of sets of ink amount Vc and height Hc corresponding to each other.

The count value N is a value equivalent to an ink discharge amount Dh (that is, the ink amount indicated by the driving signal) instructed to be discharged from the head 21 and is a value that is updated closer to a threshold Nt, after the signal output from the liquid level sensor 155 changes from the low-level signal to the high-level signal. The count value N is a value counted up with an initial value being "0". In addition, the threshold $N_{th}$ is equivalent to a volume Vth1 of the liquid chamber 171 between the upper end of the outflow port 174 and the boundary position P. The volume $V_{th1}$ is an example of a predetermined value. However, the count value N may be a value counted down with a value equivalent to the volume $V_{th1}$ as an initial value. In this case, the threshold $N_{th}$ is zero (0).

The C_Empty flag is information indicating whether the cartridge 200 is in a cartridge empty state. In the C_Empty flag, a value "ON" corresponding to the cartridge empty state or a value "OFF" corresponding to non-cartridge empty state is set. The cartridge empty state is a state where ink is not substantially stored in the cartridge 200 (more specifically, the liquid chamber 210). In other words, the cartridge empty state is a state where ink does not move from the cartridge 200 to the tank 160 communicating with the cartridge 200. Namely, the cartridge empty state is a state where the liquid level of the tank 160 communicating with the cartridge 200 is lower than the boundary position P.

The S_Empty flag is information indicating whether the tank 160 is in an ink empty state. In the S_Empty flag, a value "ON" corresponding to the ink empty state or a value "OFF" corresponding to non-ink empty state is set. The ink empty state is, for example, a state where the liquid level of the ink stored in the tank 160 (more specifically, the liquid chamber 171) reaches the position of the upper end of the outflow port 174. In other words, the ink empty state is a state where the count value N is equal to or larger than the threshold $N_{th}$. When the ink is continuously discharged from the head 21 after the ink empty state, there is a possibility that the inside of the nozzle 29 is mixed with air (so called air-in) without being filled with the ink. That is, the ink empty state is a state where the ink should be prohibited from being discharged through the head 21.

[Operation of Printer 10]

Figure 7:
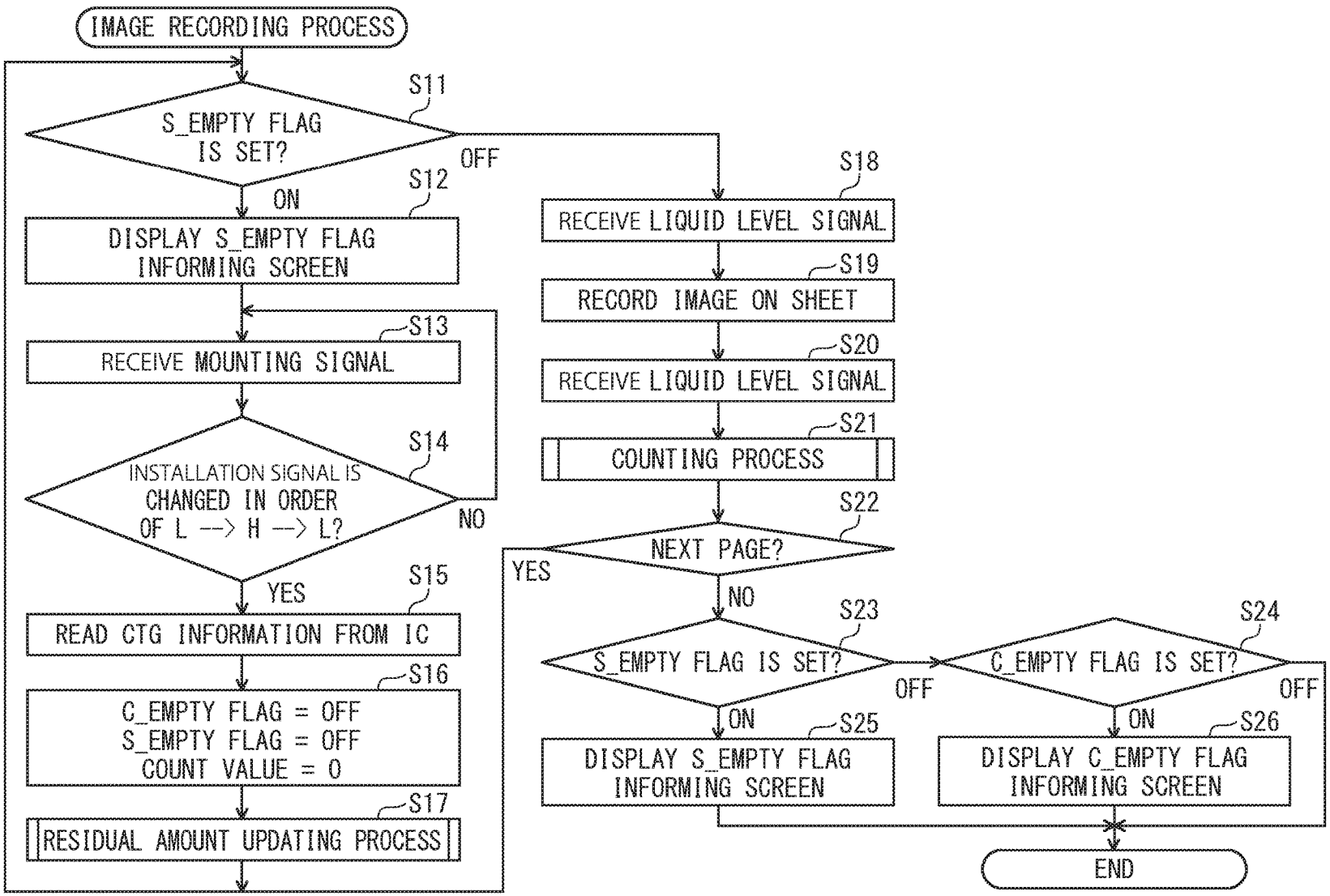
FIG. 7 is a flowchart of an image recording process.
Figure 8:
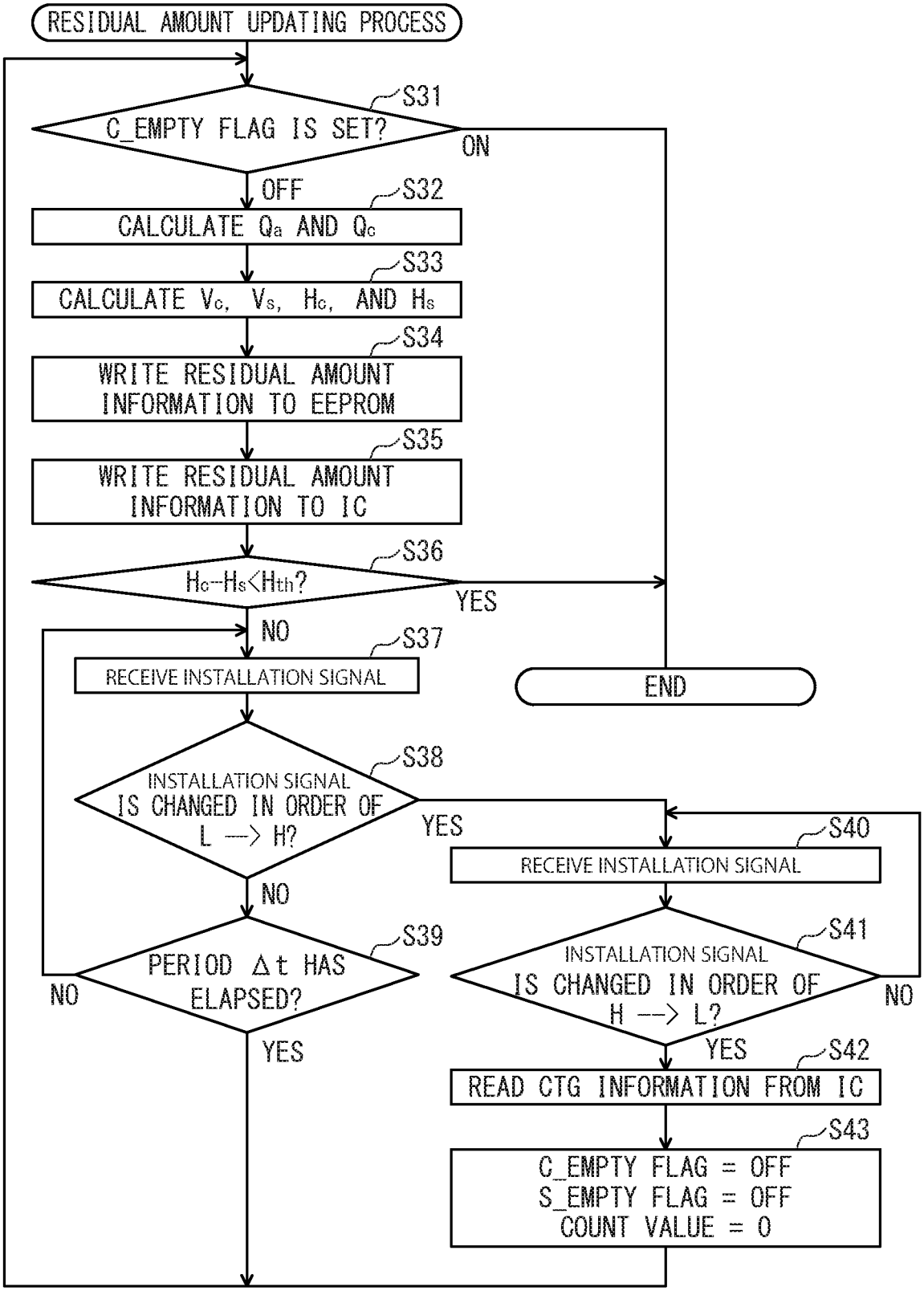
FIG. 8 is a flowchart of a residual amount updating process.
Figure 9:
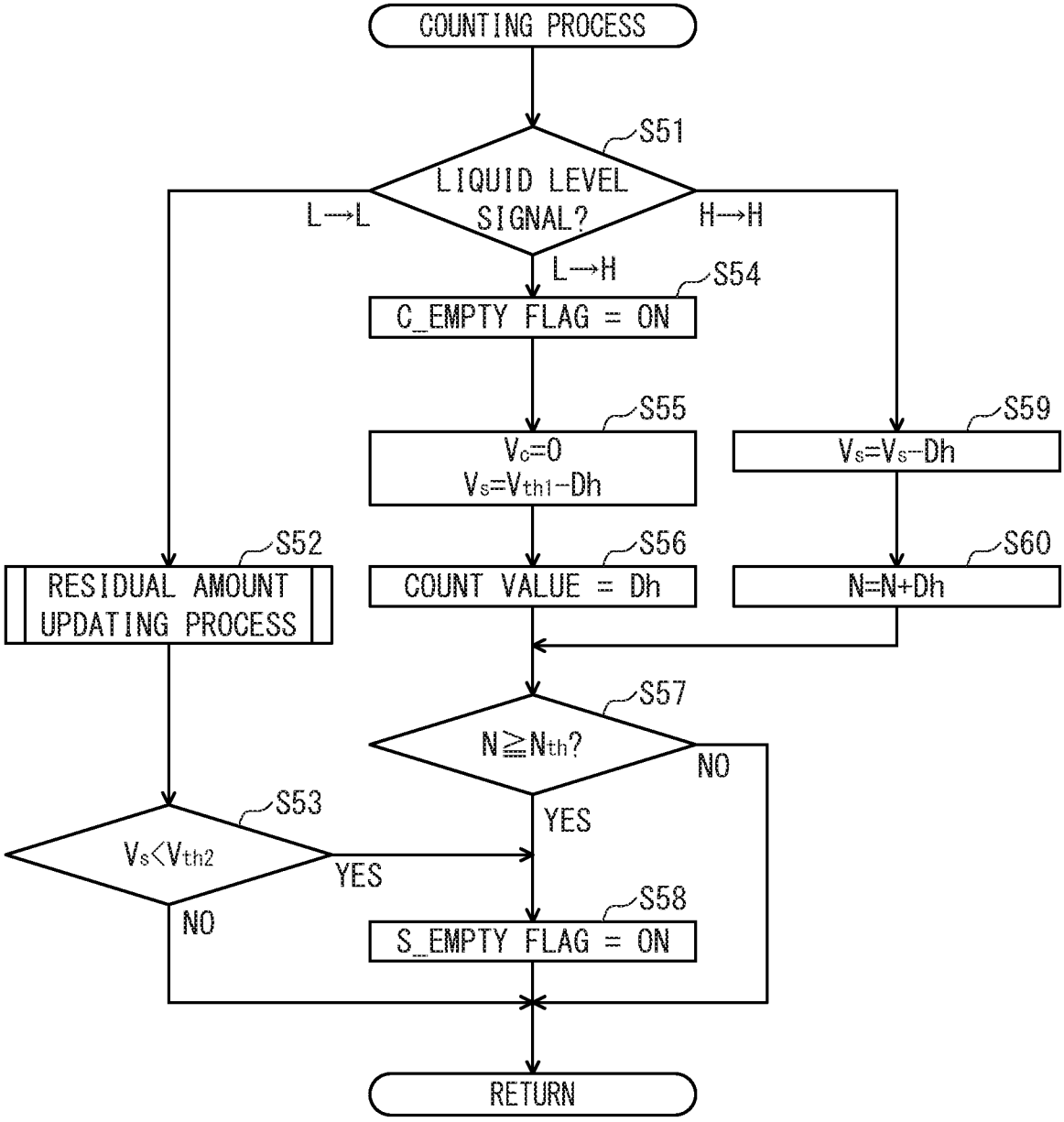
FIG. 9 is a flowchart of a counting process.

An operation of the printer 10 according to the embodiment will be described with reference to FIGS. 7 to 9. Each of processes illustrated in FIGS. 7 to 9 is executed by the CPU 131 of the controller 130. Each of the following processes may be executed by the CPU 131 reading programs stored in the ROM 132, or may be implemented a hardware circuit mounted on the controller 130. Further, execution orders of the following processes can be appropriately changed.

[Image Recording Process]

The controller 130 executes an image recording process illustrated in FIG. 7 in response to a recording instruction being input to the printer 10. The recording instruction is an example of a discharge instruction for causing the printer 10 to execute a recording process of recording an image indicated by image data on a sheet. An acquisition destination of the recording instruction is not particularly limited, but, for example, a user's operation corresponding to the recording instruction may be accepted through the operation panel 22 or may be received from an external device through a communication interface (not illustrated). The discharge instruction acquired in a state where the low-level signal is output from the liquid level sensor 155 is an example of a first discharge instruction, and the discharge instruction acquired in a state where the high-level signal is output from the liquid level sensor 155 is an example of a second discharge instruction.

First, the controller 130 determines set values of four S_Empty flags (S11). Then, the controller 130 displays an S_Empty informing screen on the display 17 in response to determining that at least one of the four S_Empty flags is set to "ON" (S11: ON) (S12). The S_Empty informing screen is a screen for informing the user that the corresponding tank 160 has entered the ink empty state. For example, the S_Empty informing screen may include information relating to the color and the ink amounts Vc and Vs of the ink stored in the tank 160 being in the ink empty state.

In addition, the controller 130 executes processes S13 to S17 for each the cartridge 200 corresponding to the S_Empty flag set to "ON". That is, the processes is executed for each the cartridge 200 among the four cartridges 200 in which the S_Empty flag is set to "ON". Since the processes S13 to S17 for each the cartridge 200 is common, only the processes S13 to S17 corresponding to one cartridge 200 will be described.

First, the controller 130 acquires a signal output from the installation sensor 154 (S13). Next, the controller 130 determines whether the signal acquired from the installation sensor 154 is a high-level signal or a low-level signal (S14). Then, the controller 130 repeatedly executes the processes S13 and S14 at predetermined time intervals until the signal output from the installation sensor 154 changes into the high-level signal from the low-level signal and changes into the low-level signal from the high-level signal again (S14: No). In other words, the controller 130 repeatedly executes the processes S13 and S14 until the cartridge 200 is removed from the installation case 150 and a new cartridge 200 is installed in the installation case 150.

Then, the controller 130 acquires the high-level signal from the installation sensor 154 after acquiring the low-level signal from the installation sensor 154, and then executes the processes S15 to S17 in response to acquiring the low-level signal from the installation sensor 154 (S14: Yes). First, the controller 130 reads CTG information from the memory of the IC chip 247 through the contact 152, and stores the read CTG information in the EEPROM 134 (S15). In addition, the controller 130 substitutes an initial value "OFF" for the C_Empty flag, substitutes the initial value "OFF" for the S_Empty flag, and substitutes the initial value "0" for the count value N (S16).

Further, the controller 130 executes a residual amount updating process (S17). The residual amount updating process is a process of updating the ink amounts Vc and Vs and the heights Hc and Hs stored in the EEPROM 134. Details of the residual amount updating process will be described below with reference to FIG. 8. As will be described in detail below, the controller 130 executes the process S11 and the subsequent processes again in parallel with the residual amount updating process or in response to the completion of the residual amount updating process. Then, the controller 130 acquires signals output from the four liquid level sensor 155 at the present time when all of the four S_Empty flags are set to "OFF" (S11: OFF) (S18). In step S18, further, the controller 130 causes the RAM 133 to store information indicating whether the signal acquired from the liquid level sensor 155 is a high-level signal or a low-level signal.

Then, the controller 130 records the image indicated by the image data included in the recording instruction on the sheet (S19). More specifically, the controller 130 causes the sheet on the feed tray 15 to be conveyed to the feed roller 23 and the conveyance roller 25, causes the head 21 to discharge the ink, and causes the sheet, on which the image is recorded, to be discharged to the discharge roller 27 via the discharge tray 16. That is, the controller 130 permits the discharge of the ink when all of the four S_Empty flags are set to "OFF". Meanwhile, the controller 130 prohibits the discharge of the ink when at least one of the four S_Empty flags is set to "ON".

Next, the controller 130 acquires signals output from the four liquid level sensors 155 at the present time in response to recording the image on the sheet according to the recording instruction (S20). In step S20, similarly to step S18, the controller 130 causes the RAM 133 to store information indicating whether the signal acquired from the liquid level sensor 155 is a high-level signal or a low-level signal. Then, the controller 130 executes a counting process (S21). The counting process is a process of updating the count value N, the C_Empty flag, and the S_Empty flag based on the signal acquired from the liquid level sensor 155 in steps S18 and S20. Details of the counting process will be described below with reference to FIG. 9.

Next, the controller 130 repeatedly executes the processes S11 to S21 until all the images indicated by the recording instruction are recorded on the sheet (S22: Yes). Then, the controller 130 determines set values of the four S_Empty flags and set values of the four C_Empty flags in response to recording all the images indicated by the recording instruction on the sheet (S22: No) (S23 and S24).

When at least one of the four S_Empty flags is set to "ON" (S23: ON), the controller 130 displays the S_Empty informing screen on the display 17 (S25). In addition, when all of the four S_Empty flags are set to "OFF" and at least one of the four C_Empty flags is set to "ON" (S23: OFF & S24: ON), the controller 130 displays the C_Empty informing screen on the display 17 (S26). The processes S25 and S26 are examples of operating the notification device.

The S_Empty informing screen displayed in step S25 may be the same as in step S12. In addition, the C_Empty informing screen is a screen for informing the user that the cartridge 200 corresponding to the C_Empty flag set to "ON" has entered the cartridge empty state. For example, the C_Empty informing screen may include information related to the color and the ink amounts Vc and Vs of the ink stored in the cartridge 200 being in the cartridge empty state. On the other hand, when all of the four S_Empty flags and the four C_Empty flags are set to "OFF" (S24: OFF), the controller 130 completes the image recording process without executing the processes S25 and S26.

A specific example of the discharge instruction is not limited to the recording instruction, but may be a maintenance instruction instructing maintenance of the nozzle 29. For example, the controller 130 executes the same processes as in FIG. 7 in response to acquiring the maintenance instruction. Differences from the above-described processes in the case of acquiring the maintenance instruction are as follows. First, the controller 130 drives a maintenance mechanism (not illustrated) in step S19, and discharges the ink through the nozzle 29. In addition, the controller 130 executes the processes of step S23 and the subsequent steps without executing step S22 after executing the counting process.

[Residual Amount Updating Process]

Figure 10A:
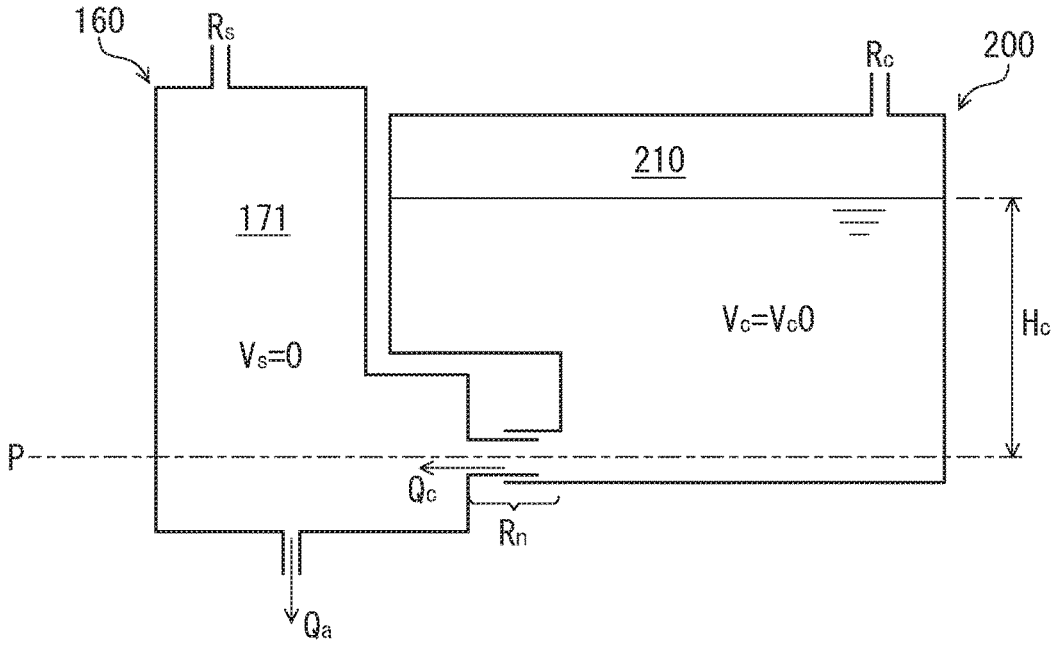
FIG. 10A is a schematic view illustrating a state where a cartridge communicates with a tank and illustrates a state where a new cartridge communicates with a tank in which ink is not stored.

Next, with reference to FIG. 8, details of the residual amount updating process executed by the controller 130 in step S17 will be described. The following description will be given on the assumption that a new cartridge 20X) (that is, stored with ink of a maximum ink amount Vc0) is installed in the installation case 150 in a state in which ink is not stored in the tank 160 as illustrated in FIG. 10A. It is assumed that the residual amount updating process is executed from a time $t_{k-1}$, at which installation of the cartridge 200 is newly detected in S14, to a time $t_k$ at which a period Δt elapses. In this case, the period Δt is $t_k-t_{k-1}$ ($\Delta t=t_k-t_{k-1}$).

First, the controller 130 determines a set value of the corresponding the C_Empty flag (S31). At the starting time point of the residual amount updating process executed in step S17, "OFF" is set in the C_Empty flag in S16. Next, when it is determined that the "OFF" has been set in the C_Empty flag (S31: OFF), the controller 130 calculates the outflow amounts Qa and Qc, the ink amounts Vc and Vs. and the heights Hc and Hs using the following Equation 1 to Equation 6 (S32 and S33).

The outflow amount Qa indicates the amount of ink discharged from the liquid chamber 171 through the outflow port 174 during the period Δt. Since no ink is discharged through the head 21 at the execution time points of S12 to S17, the ink discharge amounts Dh ($t_{k-1}$) and Dh ($t_k$) are all 0. That is, the controller 130 calculates the outflow amount Qa (=0) using the following Equation 1 (S32).

$$Q_a=Dh(t_k)-Dh(t_{k-1}) \quad \text{[Equation 1]}$$

Next, the outflow amount Qa indicates the amount of ink discharged from the liquid chamber 210 to the liquid chamber 171 through the internal space of the needle 181 and the ink valve chamber 213, which communicate with each other, during the period Δt. The controller 130 reads the heights Hc and Hs stored in the EEPROM 134 as heights Hc' and Hs' at the time $t_{k-1}$. Furthermore, the controller 130 reads the viscosity ρ and the flow path resistance Rc, Rs, and Rn from the EEPROM 134. Then, the controller 130 calculates the outflow amount Qc by putting the information read from the EEPROM 134, acceleration g of gravity, and the outflow amount Qa (=0) calculated immediately before into the following Equation 2 (S32).

$$Q_a=Dh(t_k)-Dh(t_{k-1}) \quad \text{[Equation 2]}$$

As expressed by Equation 2 above, the outflow amount Qc becomes large as a difference (that is, a water head difference) between the heights Hc' and Hs' is large and becomes small as the water head difference is small. The outflow amount Qc becomes small as the flow path resistance Rn of the internal space of the ink valve chamber 213 and the needle 181, through which ink actually passes, is large, and becomes large as the flow path resistance Rn is small.

Furthermore, when ink moves from the liquid chamber 210 to the liquid chamber 171, the liquid chamber 210 is temporarily reduced from air pressure and the liquid chamber 171 is temporarily pressurized by the air pressure. The pressure difference between the pressure in the liquid chamber 210 and the air pressure is eliminated by allowing air to flow into the liquid chamber 210 through the air valve chamber 214. Moreover, when the outflow amount Qa is 0, the pressure difference between the pressure in the liquid chamber 171 and the air pressure is eliminated by allowing air to flow out of the liquid chamber 171 through the air communication chamber 175.

These pressure differences prevent the movement of the ink from the liquid chamber 210 to the liquid chamber 171. That is, the outflow amount Qc becomes small as the flow path resistance Rc is large and becomes large as the flow path resistance Rc is small. Furthermore, when the outflow amount Qa is 0, the outflow amount Qc becomes small as the flow path resistance Rs is large and becomes large as the flow path resistance Rs is small.

Next, the controller 130 reads the ink amount Vc stored in the EEPROM 134 as an ink amount Vc' at the time $t_{k-1}$. Then, the controller 130 puts the ink amount Vc' read from the EEPROM 134 and the outflow amount Qc calculated immediately before into the following Equation 3, thereby calculating an ink amount Vc at the time $t_k$ (S33). That is, the controller 130 calculates the ink amount Vc at the time $t_k$ by subtracting the outflow amount Qc of the ink flowing into the liquid chamber 171 from the liquid chamber 210 during the period Δt from the ink amount Vc' at the time $t_{k-1}$.

$$V_c = V_c' - Q_c \quad \text{[Equation 3]}$$

Furthermore, in S33, the controller 130 reads the ink amount Vs stored in the EEPROM 134 as an ink amount Vs' at the time $t_{k-1}$. Then, the controller 130 puts the ink amount Vs' read from the EEPROM 134 and the outflow amounts Qa and Qc calculated immediately before into the following Equation 4, thereby calculating an ink amount Vs at the time $t_k$. That is, the controller 130 calculates the ink amount Vs at the time $t_k$ by subtracting the outflow amount Qa of the ink flown out of the tank 160 during the period Δt from the ink amount Vs' at the time $t_{k-1}$, and adding the outflow amount Qc flowing into the liquid chamber 171 from the liquid chamber 210 during the period Δt to the ink amount Vs' at the time $t_{k-1}$.

$$V_s = V_s' - Q_a + Q_c \quad \text{[Equation 4]}$$

Figure 10B:
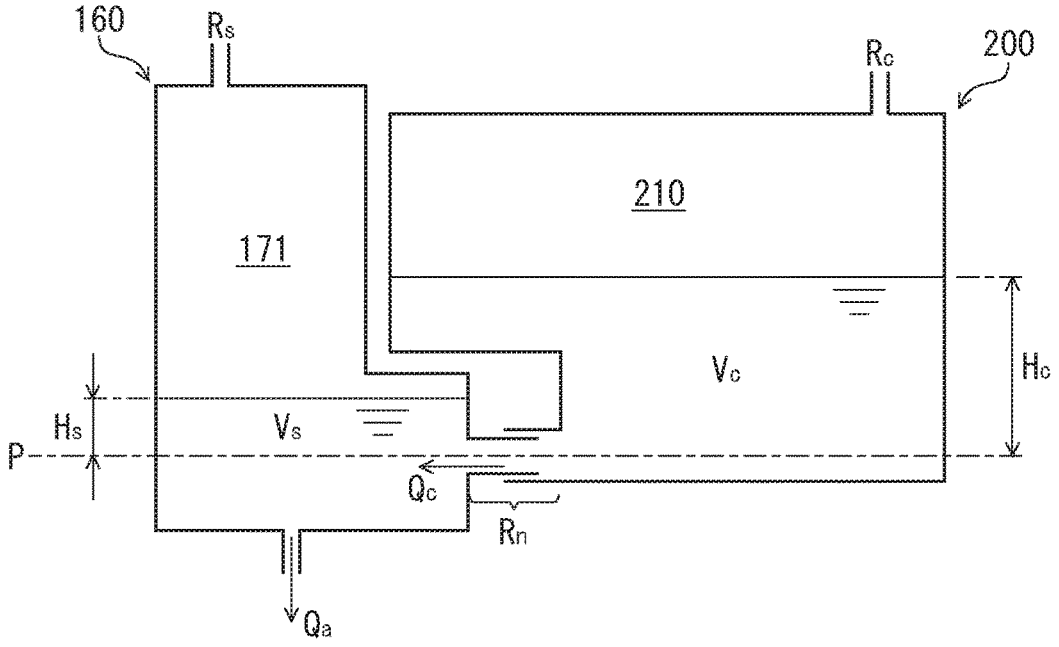
FIG. 10B is schematic view illustrating a state where the cartridge communicates with the tank and illustrates a state where some of the ink stored in the cartridge moves to the tank.
Figure 11A:
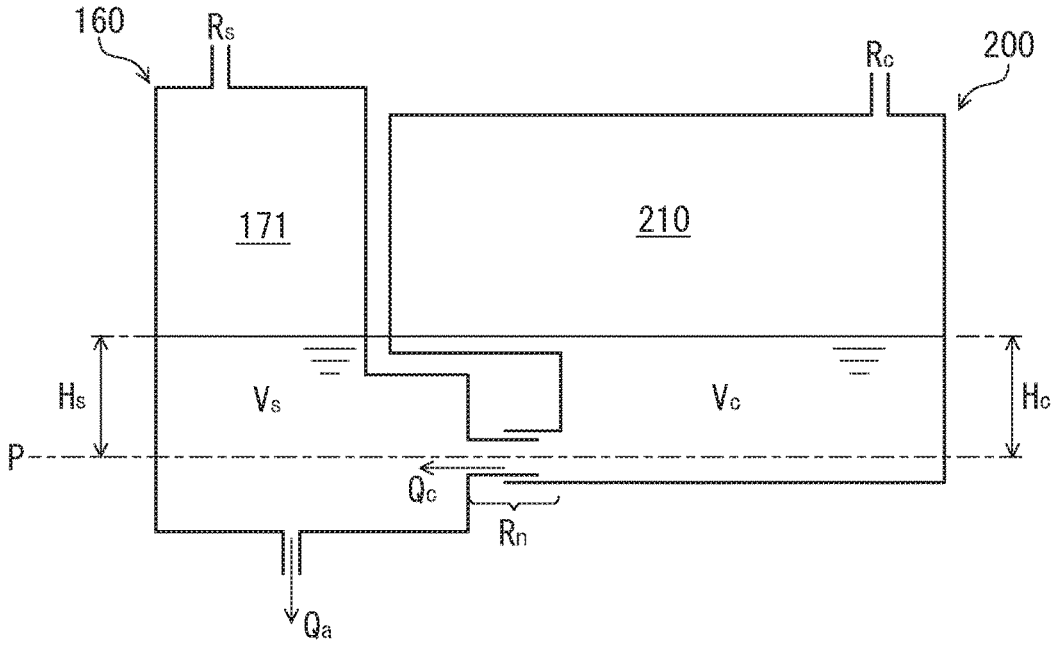
FIG. 11A is a schematic view illustrating a state where the cartridge communicates with the tank and a state where liquid levels of the tank and the cartridge are aligned.

Furthermore, in S33, the controller 130 reads the function Fc stored in the EEPROM 134. Then, the controller 130 puts the ink amount Vc calculated immediately before in the function Fc as expressed by the following Equation 5, thereby specifying the height Hc at the time tk. Moreover, in S33, the controller 130 compares the ink amount Vs calculated immediately before with the volume $V_{th1}$. Then, when it is determined that the ink amount Vs is equal to or less than the volume $V_{th1}$ (that is, the liquid level of the liquid chamber 171 is equal to or less than the boundary position P as illustrated in FIG. 10A), the controller 130 specifies the height Hs (=0) at the time $t_k$ as expressed by Equation 6 below. On the other hand, when it is determined that the ink amount Vs is larger than the volume $V_{th1}$ (that is, the liquid level of the liquid chamber 171 is higher than the boundary position P as illustrated in FIGS. 10B and 11A), the controller 130 reads the function Fs from the EEPROM 134. Then, the controller 130 puts the ink amount Vs calculated immediately before into the function Fs as expressed by the following Equation 6, thereby specifying the height Hs at the time $t_k$ (S33).

$$H_c = F_c(V_c) \quad \text{[Equation 5]}$$

$$H_s = \begin{cases} 0 & (V_s \leqq V_{th1}) \\ F_s(V_s) & (V_s > V_{th1}) \end{cases} \quad \text{[Equation 6]}$$

Next, the controller 130 stores the ink amounts Vc and Vs and the heights Hc and Hs calculated in S33 in the EEPROM 134 (S34). More specifically, the controller 130 overwrites the ink amounts Vc and Vs and the heights Hc and Hs, which are stored in the EEPROM 134, with the ink amounts Vc and Vs and the heights Hc and Hs calculated in the immediately previous S33. Furthermore, the controller 130 stores the ink amount Vc and the height Hc calculated in S33 in the memory of the IC chip 247 through the contact 152 (S35). More specifically, the controller 130 overwrites the ink amount Vc and the height Hc, which are stored in the second area of the memory of the IC chip 247, with the ink amount Vc and the height Hc calculated in the immediately previous S33.

In addition, before the process of S35, the controller 130 may acquire the signal output from the cover sensor 88 and determine whether the acquired signal is a high-level signal or a low-level signal. Then, the controller 130 may execute the process of S35 in response to the acquisition of the high-level signal from the cover sensor 88. On the other hand, the controller 130 may also execute processes subsequent to S36 without executing the process of S35 in response to the acquisition of the low-level signal from the cover sensor 88.

Next, the controller 130 compares the difference between the heights Hc and Hs calculated in the immediately previous S33 with a threshold height $H_{th}$ (S36). The threshold height $H_{th}$ indicates a water head difference by which no ink is considered to actually move between the liquid chambers 210 and 171. The threshold height $H_{th}$, for example, is 0. A state, in which no ink actually moves between the liquid chambers 210 and 171, is assumed as an equilibrium state. That is, in this equilibrium state, the water head difference between the liquid chambers 210 and 171 is actually 0.

Next, when it is determined that the difference between the heights Hc and Hs is equal to or more than the threshold height Hth (S36: No), the controller 130 acquires a signal output from the installation sensor 154 (S37). Next, the controller 130 determines whether the signal output from the installation sensor 154 is a high-level signal or a low-level signal (S38). Then, until the signal output from the installation sensor 154 is changed from the low-level signal into the high-level signal (S38: No), or until the period Δt elapses after the immediately previous processes of S32 to S35 are executed (S39: No), the controller 130 repeatedly executes the processes of S37 and S38 at a predetermined time interval shorter than the period Δt.

Next, the controller 130 executes the processes subsequent to S31 again in response to the lapse of the period Δt during no change in the output of the installation sensor 154 (S38: No & S39: Yes). In other words, until the period Δt elapses after the processes of S32 to S35 are executed immediately before, the controller 130 waits for the next processes of S32 to S35. When the processes of S31 to S39 are repeatedly executed, the difference between the heights Hc and Hs is gradually reduced as illustrated in FIGS. 10A and 10B, and FIG. 11A. Then, when it is determined that the difference between the heights Hc and Hs is smaller than the threshold height $H_{th}$ (S36: Yes), the controller 130 ends the residual amount updating process. That is, it is probable that the residual amount updating process corresponding to each of the four cartridges 200 will be completed at different timings.

The controller 130 may change the period Δt in S39. More specifically, the controller 130 may shorten the period Δt in S39 as the difference between the heights Hc and Hs calculated in the immediately previous S33 is large, or may lengthen the period Δt in S39 as the difference between the heights Hc and Hs calculated in the immediately previous S33 is small. That is, the controller 130 may shorten the interval (in other words, the updating interval of the ink amounts Vc and Vs and the heights Hc and Hs) of the processes of S32 to S35 repeatedly executed as the difference between the heights Hc and Hs is large, or may lengthen the interval as the difference between the heights Hc and Hs is small.

On the other hand, when it is determined that the output of the installation sensor 154 has changed from the low-level signal into the high-level signal before the period Δt elapses (S39: No & S38: Yes), the controller 130 executes processes of S40 to S43, instead of the processes of S31 to S39. The change from the low-level signal into the high-level signal in the output of the installation sensor 154 corresponds to detachment of the cartridge 200 from the installation case 150. That is, the processes of S32 to S35 are repeatedly executed while the cartridge 200 is being installed in the installation case 150, and are stopped when the cartridge 200 is detached from the installation case 150.

Then, the controller 130 repeatedly acquires the signal output from the installation sensor 154 at a predetermined time interval (S40) until the output of the installation sensor 154 changes again from the high-level signal into the low-level signal (S41: No). Then, the controller 130 executes the processes of S42 and S43 and executes the processes subsequent to S31 again in response to the change from the high-level signal into the low-level signal in the output of the installation sensor 154 (S41: Yes). The processes of S37, S38, S40, and S41 correspond to the processes of S13 and S14 of FIG. 7. Furthermore, the processes of S42 and S43 correspond to the processes of S15 and S16 of FIG. 7.

As an example, the controller 130 may also execute the processes subsequent to S11 in response to the end of the residual amount updating process started in S17. In this case, as illustrated in FIG. 11A, in a state in which the liquid levels of the liquid chambers 210 and 171 are aligned, the discharge of ink through the head 21 is started.

An another example, the controller 130 may also execute the processes subsequent to S11 together with the residual amount updating process started in S17. In this case, as illustrated in FIG. 10B, in a state in which a water head difference occurs between the liquid chambers 210 and 171, the discharge of ink through the head 21 is started.

[Counting Process]

Next, details of the counting process executed by the controller 130 in S21 will be described with reference to FIG. 9. The controller 130 independently executes the counting process with respect to each of the four cartridges 200. Since the counting process is common for each cartridge 200, only the counting process corresponding to one cartridge 200 will be described.

First, the controller 130 compares information indicating the signals of the liquid level sensors 155 stored in the RAM 133 in S18 and S20 with one another (S51). That is, the controller 130 determines a change in the signal of each of the four liquid level sensors 155 before and after the process of S19 is executed immediately before the counting process (S21) is executed.

The controller 130 executes the residual amount updating process in response to the fact (S51: L→L) that the information stored in the RAM 133 in S18 and S20 indicates the low-level signal (that is, there is no change in the output of the liquid level sensors 155 before and after the process of S19) (S52). On the other hand, when the residual amount updating process is started in S17 and the process of S19 is executed before the equilibrium state is reached, since the residual amount updating process started in S17 is continuously executed, the residual amount updating process does not need to be started again in S52. The residual amount updating process in S52 is different from the aforementioned description in that the outflow amount Qa is not 0. Hereinafter, detailed description for common points with the aforementioned description will be omitted and differences will be mainly described.

First, the controller 130 puts the ink discharge amount Dh from the start time $t_{k-1}$ of S19 to the end time $t_k$ into Equation 1 above, thereby calculating the outflow amount Qa (S32). In this case, the period Δt corresponds to a period required for recording an image on one sheet. Furthermore, in this case, the ink discharge amount Dh corresponds to the total discharge amount of ink to be discharged to one sheet. That is, it is sufficient if the controller 130 executes the processes of S32 to S35 whenever the recording of the image to one sheet is ended. It is noted that the specific example of the period Δt and the ink discharge amount Dh is not limited thereto.

In another example, the period Δt corresponds to a period required for executing the recording of an image corresponding to one path. In this case, the time $t_{k-1}$ is a time at which the recording of the image corresponding to one path is started. Furthermore, the time $t_k$ is a time at which the recording of the image corresponding to one path is ended. Furthermore, the ink discharge amounts Dh ($t_{k-t}$) corresponds to the amount of ink instructed to be discharged from the start of S19 to the time $t_{k-1}$. Moreover, the ink discharge amounts Dh ($t_k$) corresponds to the amount of ink instructed to be discharged from the start of S19 to the time tk. That is, the controller 130 may also execute the processes of S32 to S35 whenever the recording of the image corresponding to one path is ended. In further another example, the controller 130 may also execute the processes of S32 to S35 at an arbitrary timing having no relation with the division of image recording.

Furthermore, the controller 130 puts the heights Hc' and Hs', the viscosity p, and the flow path resistance Rc, Rs, and Rn stored in the EEPROM 134, and the outflow amount Qa calculated immediately before into Equation 2 above, thereby calculating the outflow amount Qc (S32).

The liquid chambers 210 and 171 in the equilibrium state are maintained at the air pressure. When ink is discharged through the head 21 from this state, the ink flows out of the liquid chamber 171 through the outflow port 174. Moreover, the ink moves from the liquid chamber 210 to the liquid chamber 171 through the internal space of the needle 181 and the ink valve chamber 213. Then, when the outflow amount Qa becomes large, since the water head difference of the liquid chamber 210 and 171 becomes large, the outflow amount Qc becomes large as the outflow amount Qa becomes large.

Furthermore, since the ink is discharged through the head 21, the liquid chamber 171 is temporarily reduced from the air pressure. The pressure difference between the pressure in the liquid chamber 171 and the air pressure is eliminated when the ink moves from the liquid chamber 210 to the liquid chamber 171 and air flows into the liquid chamber 171 through the air communication chamber 175. The amount of the air flowing into the liquid chamber 171 through the air communication chamber 175 becomes small as the flow path resistance Rs is large, and becomes large as the flow path resistance Rs is small. By so doing, the outflow amount Qc when the outflow amount Qa>0 becomes large as the flow path resistance Rs is large and becomes small as the flow path resistance Rs is small, in order to allow the inside of the liquid chamber 171 to return to the air pressure.

Returning to FIG. 9, the controller 130 reads the ink amount Vs from the EEPROM 134 and compares the read ink amount Vs with a volume $V_{th2}$ (S53). The volume $V_{th2}$ is an example of a threshold amount smaller than the volume $V_{th1}$. More specifically, the volume Vth, for example, is a value obtained by subtracting at least one of a discharge error and a dispensation error from the volume $V_{th1}$. The discharge error is an assumed value of a difference between the amount of ink instructed to be discharged by a discharge instruction and the amount of ink actually discharged through the nozzle 29 until a new cartridge 200 is installed in the installation case 150 and then enters an ink empty state. The dispensation error is an assumed value of a difference between the amount of ink actually stored in the liquid chamber 210 of the new cartridge 200 and the maximum ink amount Vc0 stored in the memory of the IC chip 247.

Then, when it is determined that the read ink amount Vs is smaller than the volume Vth2 (S53: Yes), the controller 130 puts "ON" into the S_Empty flag (S58) and ends the counting process. On the other hand, when it is determined that the read ink amount Vs is equal to or more than the volume Vth2 (S53: No), the controller 130 ends the counting process without executing the process of S58.

Figure 11B:
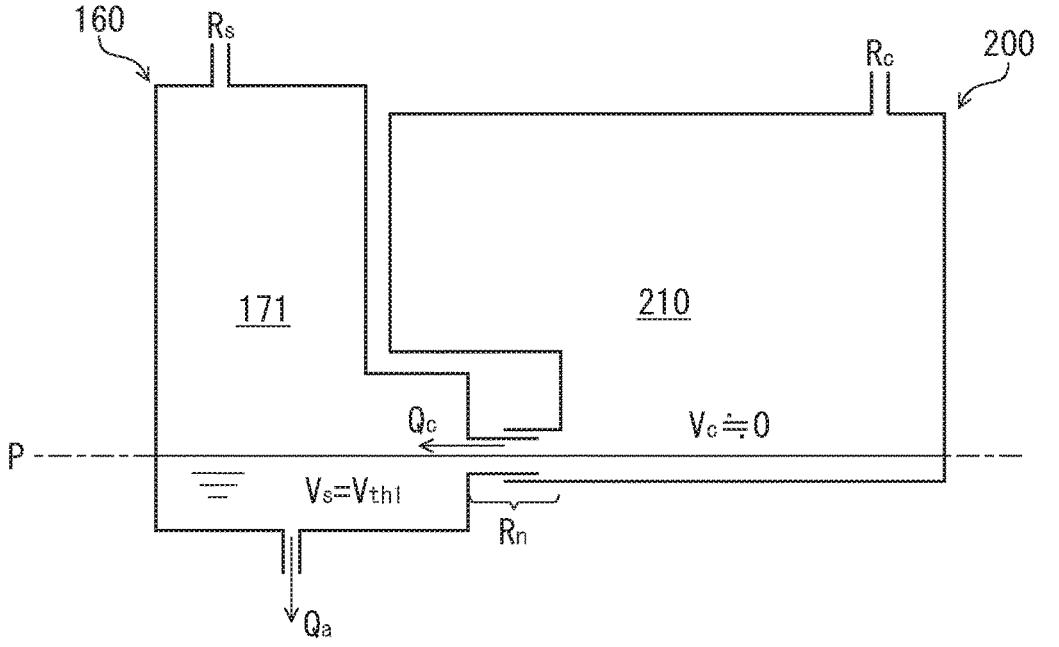
FIG. 11B is a schematic view illustrating a state where the cartridge communicates with the tank and illustrates a cartridge empty state.

Furthermore, the controller 130 substitutes "ON" for the C_Empty flag in response to the fact (S51: L→H) that the information stored in the RAM 133 in S18 indicates the low-level signal and the information stored in the RAM 133 in S20 indicates the high-level signal (that is, there is no change in the output of the liquid level sensors 155 before and after the process of S19) (S54). The change from the low-level signal into the high-level signal in the output of the liquid level sensors 155 corresponds to the fact that the liquid level of the liquid chamber 171 reaches the boundary position P during the process of S19 as illustrated in FIG. 11B. Then, there is no ink movement between the cartridge 200 and the tank 160. As illustrated in FIG. 8, the controller 130 ends the residual amount updating process in response to the setting of "ON" in the C_Empty flag (S31: ON).

Furthermore, the controller 130 overwrites the ink amount Vc stored in the EEPROM 134 with a predetermined value (=0) (S55). Similarly, the controller 130 overwrites the ink amount Vs stored in the EEPROM 134 with a predetermined value (=volume Vth1-ink discharge amount Dh) (S55). Since the ink amounts Vc and Vs calculated in the residual amount updating process include errors, the errors accumulated in the ink amounts Vc and Vs become large as the number of repetitions of the processes of S32 to S35 increases. In this regard, the controller 130 puts a prescribed value into the ink amounts Vc and Vs at the timing at which the output of the liquid level sensors 155 has changed from the low-level signal to the high-level signal, thereby resetting the accumulated errors.

As described above, the ink discharge amount Dh corresponds to the amount of ink discharged to one sheet in the immediately previous S19. On the other hand, the change in the output of the liquid level sensors 155 is in the middle of the process of S19. That is, the ink amount Vs overwritten in S55 slightly deviates from the amount of ink stored in the tank 160 at the moment at which the output of the liquid level sensors 155 has changed. However, since the deviation is slight, it is assumed that the ink amount Vs overwritten in S55 is treated as the ink amount Vs at the time point at which the output of the liquid level sensors 155 has changed.

Furthermore, the controller 130 puts the ink discharge amount Dh into the count value N stored in EEPROM 134 (S56). That is, the controller 130 counts up the count value N with a value corresponding to the amount of ink instructed to be discharged in the immediately previous S19. In other words, the controller 130 starts to update the count value N in response to the change from the low-level signal into the high-level signal in the output of the liquid level sensors 155.

Next, the controller 130 compares the count value N updated in $56 with the threshold value Nth (S57). When it is determined that the count value N updated in S56 is smaller than the threshold value Nth (S57: No), the controller 130 ends counting process without executing a process of S58. On the other hand, when it is determined that the count value N updated in S56 is equal to or more than the threshold value Nth (S57: Yes), the controller 130 puts "ON" into the S_Empty flag (S58) and ends counting process.

Furthermore, the controller 130 reads the ink amount Vs stored in the EEPROM 134 in response to the fact (S51: H→H) that the information stored in the RAM 133 in S18 and S20 indicates the high-level signal. Then, the controller 130 subtracts the ink discharge amount Dh from the read ink amount Vs and stores the reduced ink discharge amount Dh in the EEPROM 134 again (S59). Furthermore, the controller 130 reads the count value N stored in the EEPROM 134. Then, the controller 130 adds the ink discharge amount Dh to the read count value N and the added ink discharge amount Dh in the EEPROM 134 again (S60). That is, the controller 130 updates the ink amount Vs and the count value N, which are stored in the EEPROM 134, with the ink discharge amount Dh instructed to be discharged in the immediately previous S19. Next, the controller 130 executes processes subsequent to the aforementioned S57 using the count value N updated in S60.

That is, the controller 130 executes the counting process for each cartridge 200 whenever ink is discharged through the head 21. For example, when one cartridge 200 is employed as an object, the residual amount updating process is executed for a while after the cartridge 200 installing in the installation case 150 (S51: L→L), the processes of S54 to S58 are executed only once at the timing at which the output of the liquid level sensors 155 has changed before the ink amount Vs reaches the volume $V_t$(S53: No & S51: L→H), and then the processes of S59 and S60 and S57 and S58 are executed until there is no ink in the tank 160 (S51: H→H). On the other hand, when the ink amount Vs reaches the volume Vth2 before the output of the liquid level sensors 155 changes (S51: L→L & S53: Yes), the processes of S54 to S57 and S59 and S60 are not executed and the ink empty state is reached.

In the printer 10 of the aforementioned embodiment, when the ink amount Vs is smaller than the volume $V_{th2}$ before the output of the liquid level sensor 155 changes from the low-level signal from the high-level signal, it can be considered that the liquid level sensor 155 malfunctions. Such a problem is more considerable when the actuator 190 is arranged in the tank 160 as with the printer 10 of the aforementioned embodiment, as compared with the case where the actuator 190 is arranged in the exchangeable cartridge 200.

In this regard, as described above, when the ink amount Vs is smaller than the volume $V_{th2}$ before the output of the liquid level sensor 155 changes from the low-level signal from the high-level signal (S51: L→L & S53: Yes), the printer 10 prohibits the discharge of ink through the head 21 (S58). In this way, even though the liquid level sensor 155 malfunctions, it is possible to effectively prevent air-in.

More specifically, even though the ink amount Vs is smaller than the volume $V_{th2}$, the printer 10 prohibits the discharge of ink at the time point, at which the ink amount Vs is smaller than the volume $V_{th2}$, in response to the output of the low-level signal from the liquid level sensor 155. On the other hand, the printer 10 enables the discharge of ink until the count value N reaches the threshold value $N_{th}$ in response to the change from the low-level signal into the high-level signal in the output of the liquid level sensors 155 when the ink amount Vs is equal to or more than the volume $V_{th2}$.

In this regard, for example, it is sufficient if a difference between the initial value of the count value N and the threshold value Nth is set to be larger than a difference between the ink amount Vs ($=V_{th1}$) when the normal liquid level sensors 155 outputs the high-level signal and the volume $V_{th2}$. In this way, when the liquid level sensor 155 normally operates, a larger amount of ink can be discharged through the head 21 as compared with the case where the liquid level sensor 155 malfunctions. That is, it is possible to achieve both the discharge of the liquid stored in the cartridge 200 without waste and the prevention of the air-in.

Furthermore, according to the aforementioned description, whenever the output of the liquid level sensors 155 changes from the low-level signal from the high-level signal (S51: L→H), the printer 10 puts a predetermined value into the ink amount Vc and Vs (S55 and S56). In this way, the errors accumulated in the ink amount Vc and Vs calculated using Equations 3 and 4 above are reset. As a consequence, information associated with the ink amount Vc and Vs having a reduced error can be informed to a user through an S_Empty informing screen, a C_Empty informing screen and the like. An object associated with the ink amount Vc and Vs, for example, may include the ink amount Vc and Vs itself, or an estimation value of the number of sheets capable of recording an image with ink corresponding to the ink amount Vc and Vs.

Furthermore, according to the aforementioned description, even though a difference occurs in the liquid level heights of the liquid chamber 210 and 171 due to discharge of ink to the head 21, the printer 10 can individually calculate the ink amount Vc and Vs according to Equation 1 to Equation 4 above. Furthermore, since the printer 10 calculates the outflow amount Qc in consideration of the heights Hc and Hs in Equation 2, it is possible to appropriately calculate the outflow amount Qc even though the liquid levels of the liquid chamber 210 and 171 have not been already aligned at the acquisition time point of the discharge instruction. As a consequence, it is possible to appropriately calculate the ink amount Vc and Vs.

Furthermore, according to the aforementioned description, even though the liquid level heights of the liquid chamber 210 and 171 are different from each other at the time point at which the cartridge 200 is mounted on the installation case 150, the printer 10 can individually calculate the ink amount Vc and Vs according to Equation 1 to Equation 4 above during the period in which the liquid levels of the liquid chamber 210 and 171 are aligned. However, when the cartridge 200 is detached from the installation case 150, since there is no ink movement, it is desired that the printer 10 stops the processes of S32 to S35 in response to the output of the high-level signal from the installation sensor 154, regardless of whether the heights Hc and Hs are smaller than the threshold height $H_{th}$.

Furthermore, according to the aforementioned description, the printer 10 repeatedly executes the processes of S32 to S35 whenever the period Δt elapses. As a consequence, the printer 10 can grasp the ink amount Vc and Vs in real time during the period in which the liquid levels of the liquid chamber 210 and 171 are aligned. The outflow amount Qc becomes large as the difference between the heights Hc and Hs is large and becomes small as the difference between the heights Hc and Hs is small. In this regard, as described above, the frequency of execution of S32 to S35 is changed according to the difference between the heights Hc and Hs, and thus the liquid amounts Vc and Vs can be grasped in real time and the processing load of the controller 130 can be reduced.

In addition, the combination of the ink amount and the threshold amount compared in S53 is not limited to the aforementioned example. In another example, the threshold amount may indicate a change amount of the ink amount Vs when the ink amount Vc becomes zero. That is, the controller 130 allows the ink amount Vs when the ink amount Vc calculated in S33 becomes zero to be stored in the EEPROM 134 as a reference ink amount Vs0. Then, in S53, the controller 130 may compare a difference between the ink amount Vs calculated immediately before and the reference ink amount Vs0 with a threshold amount. In another example, the ink amount V may be the total of the ink amount Vc and Vs and the threshold amount may be 0.

Furthermore, in the aforementioned description, the ink has been described as an example of liquid. However, the liquid, for example, may be pretreatment liquid discharged to a paper and the like prior to ink at the time of image recording, or may be water for cleaning the head 21.

As described in the above with reference to the embodiment, according to the present disclosure, there is provided following configurations.

(1) A liquid discharge apparatus according to an aspect of the present disclosure may be configured to include: an installation case configured to receive a cartridge including a first liquid chamber in which a liquid is stored, a first flow path in which one end thereof communicates with the first liquid chamber and the other end communicates with the outside, and a second flow path in which one end thereof communicates with the first liquid chamber and the other end communicates with the outside; a tank including: a second liquid chamber; a third flow path in which one end thereof communicates with the outside and the other end communicates with the second liquid chamber, at least one of the first flow path and the third flow path configured to communicate with the first chamber of the cartridge installed in the installation case and the second chamber; a fourth flow path in which one end thereof located below the third flow path communicates with the second liquid chamber: and a fifth flow path in which one end thereof communicates with the second liquid chamber and the other end communicates with the outside: a head that communicates with the other end of the fourth flow path: a memory storing a liquid amount V for specifying an amount of a liquid stored in the first liquid chamber and the second liquid chamber: a liquid level sensor; and a controller. The controller may be configured to: receive a first discharge instruction for discharging the liquid through the head: based on the received discharge instruction, control discharging the liquid through the head; update the liquid amount V stored in the memory with a value equivalent to the amount of the liquid instructed to be discharged by the received first discharge instruction; determine whether the updated liquid amount V is equal to or larger than a threshold amount; receive a first signal output from the liquid level sensor in response to a position of a liquid level in the second liquid chamber being equal to or higher than a boundary position or a second signal output from the liquid level sensor in response to the position being lower than the boundary position, from the liquid level sensor, after discharging the liquid according to the first discharge instruction: in response to determining that the updated liquid amount V, at receiving the second signal from the liquid level sensor, is equal to or larger than the threshold amount, update the liquid amount V stored in the memory to a predetermined value; and in response to determining that the updated liquid amount V, at receiving the first signal from the liquid level sensor, is less than the threshold amount, prohibit the liquid from being discharged through the head.

According to the above configuration, the liquid discharge apparatus prohibits the subsequent discharge of the liquid through the head when the liquid amount V is less than the threshold amount before the signal output from the liquid level sensor changes into the second signal from the first signal. In the liquid discharge apparatus having the above configuration, when the liquid amount V becomes less than the threshold amount before the signal output from the liquid level sensor changes into the second signal from the first signal, it is considered that the liquid level sensor has malfunctioned. That is, according to the above configuration, even if the liquid level sensor malfunctions, air-in can be effectively prevented.

(2) For example, the liquid amount V is a liquid amount Vs stored in the second liquid chamber, wherein the predetermined value is equivalent to a volume of a part of the second liquid chamber located below the boundary position, and wherein the threshold amount is less than the predetermined value.

(3) Preferably, the controller is configured to after updating the liquid amount V to the predetermined value, receive a second discharge instruction for discharging a liquid through the head; based on the received second discharge instruction, control discharging the liquid through the head; update a count value to be closer to a threshold with a value equivalent to the amount of the liquid instructed to be discharged by the received second discharge instruction; determine whether the count value reaches the threshold: and prohibit the liquid from being discharged through the head in response to determining that the count value reaches the threshold.

When the first signal is output from the liquid level sensor even if the liquid amount V becomes less than the threshold amount, the discharge of the liquid is prohibited when the liquid amount V becomes less than the threshold amount. On the other hand, when the second signal is received from the liquid level sensor in the case where the liquid amount V is equal to or larger than the threshold amount, the liquid can be discharged until the count value reaches the threshold. Therefore, if the difference between the initial value of the count value and the threshold is set larger than the difference between the liquid amount V and the threshold amount when the normal liquid level sensor outputs the second signal, when the liquid level sensor normally operates, a larger amount of liquid is discharged through the head as compared with a case where the liquid level sensor malfunctions. That is, it is possible to achieve both the discharge of the liquid stored in the cartridge without waste and the prevention of the air-in.

(4) Preferably, the liquid discharge apparatus includes a display. The controller may be configured to display information related to the liquid amount Vs on the display.

Since the liquid amount Vs is updated to the predetermined value when the signal output from the liquid level sensor changes into the second signal from the first signal, the error accumulated in the calculated liquid amount Vs is reset. Therefore, according to the above configuration, it is possible to inform a user of the liquid amount Vs with a small error.

(5) Preferably, the liquid amount V further includes a liquid amount Vc stored in the first liquid chamber. The controller may be configured to: determine a discharge amount Dh of the liquid indicated in the first discharge instruction: based on the calculated discharge amount Dh, determine an outflow amount Qa indicating amount of the liquid flowed out from the fourth flow path toward the head for a time period Δt during which the liquid is discharged through the head; based on the calculated outflow amount Qa, a flow path resistance Rc of the second flow path, a flow path resistance Rs of the fifth flow path, and a flow path resistance Rn indicating one resistance or both resistances of the first flow path and the third flow path, determine an outflow amount Qc of the liquid flowing from the first liquid chamber to the second liquid chamber for a time period Δt during which the liquid is discharged through the head; read out the liquid amount Vc and the liquid amount Vs from the memory; subtract the outflow amount Qc from the read liquid amount Vc to determine the liquid amount Vc after a lapse of the time period Δt; subtract the outflow amount Qa from the read liquid amount Vs and adds the outflow amount Qc to determine the liquid amount Vs after the lapse of the time period Δt: and store the determined liquid amount Vs and the determined liquid amount Vc in the memory.

(6) Further preferably, a part of the first liquid chamber may overlap with a part of the second liquid chamber as seen in a horizontal direction in a state where the cartridge is installed in the installation case, and wherein the controller is configured to determine the outflow amount Qc that increases as a difference between a height Hc from a reference position to a liquid level of the first liquid chamber and a height Hs from the reference position to the liquid level of the second liquid chamber becomes larger.

According to the above configuration, it is possible to appropriately calculate the liquid amounts Vc and Vs of the first liquid chamber and the second liquid chamber.

(7) Preferably, the liquid discharge apparatus may further include an interface, wherein the cartridge includes a cartridge memory. The controller may be configured to: determine whether the cartridge is installed in the installation case; in response to determining that the cartridge is installed in the installation case, read out the liquid amount Vc from a cartridge memory of the cartridge through the interface; and store the read liquid amount Vc in the memory.

According to the above configuration, even when the volume of the first liquid chamber is different for each cartridge or the cartridge is detached from another liquid discharge apparatus, the liquid amounts Vc and Vs can be appropriately updated.

(8) Preferably, the controller may be configured to: stand by from the time point at which the liquid amount Vc and the liquid amount V are stored in the memory until the time period Δt elapses: and in response to the time period Δt being elapsed, redetermine the outflow amount Qa, the outflow amount Qc, the liquid amount Vc and the liquid amount Vs; and store the determined liquid amount Vs and the determined liquid amount Vc in the memory.

(9) Preferably, the controller may be configured to: in response to storing the liquid amount Vc and the liquid amount Vs in the memory, determine whether the difference between a height Hc from a reference position to a liquid level of the first liquid chamber and a height Hs from the reference position to a liquid level of the second liquid chamber is less than a threshold height; and in response to determining that the difference between the height Hc and the height Hs is equal to or more than the threshold height, stand by until the time period Δt elapses.

(10) Preferably, the controller may be configured to: in response to determining that the difference between the height Hc and the height Hs is less than the threshold height, stop the determination of the outflow amount Qa, the outflow amount Qc, the liquid amount Vc and the liquid amount Vs and stop the storing of the determined liquid amount Vc and the determined liquid amount Vs in the memory.

According to the above configuration, it is possible to grasp the liquid amounts Vc and Vs in real time during the period until the liquid levels of the first liquid chamber and the second liquid chamber are aligned.

(11) Preferably, the controller may be configured to: as the difference between the height Hc and the height Hs comes close to the threshold height, lengthen the time period Δt.

The outflow amount Qc increases as the difference between the heights Hc and Hs becomes larger, and decreases as the difference between heights Hc and Hs becomes smaller. Therefore, the update frequency of the liquid amounts Vc and Vs is changed according to the difference between the heights Hc and Hs as in the above configuration, and thus the liquid amounts Vc and Vs can be grasped in real time and the processing load of the controller can be reduced.

(12) For example, the boundary position may be a position that is equal to or lower than an imaginary line extending a horizontal direction through the one of the first flow path and the third flow path, in a state of being installed in the installation case.

(13) For example, the liquid amount V may include a liquid amount Vc stored in the first liquid chamber and a liquid amount Vs stored in the second liquid chamber, wherein the threshold amount indicates a change amount of the liquid amount Vs after the liquid amount Vc becomes 0, and wherein the predetermined value is equivalent to a volume of a part of the second liquid chamber located below the boundary position.

(14) For example the liquid amount V may be a total amount of liquid stored in the first liquid chamber and the second liquid chamber, and wherein the threshold amount may be 0.

(15) A liquid discharge apparatus according to another aspect of the present disclosure may be configured to include: a cartridge including a first liquid chamber in which a liquid is stored, a first flow path in which one end thereof communicates with the first liquid chamber and the other end communicates with the outside, and a second flow path in which one end thereof communicates with the first liquid chamber and the other end communicates with the outside; an installation case configured to receive the cartridge; a tank including: a second liquid chamber; a third flow path in which one end thereof communicates with the outside and the other end communicates with the second liquid chamber, at least one of the first flow path and the third flow path configured to communicate with the first chamber of the cartridge installed in the installation case and the second chamber; a fourth flow path in which one end thereof located below the third flow path communicates with the second liquid chamber; and a fifth flow path in which one end thereof communicates with the second liquid chamber and the other end communicates with the outside; a head that communicates with the other end of the fourth flow path; a memory storing a liquid amount V for specifying an amount of a liquid stored in the first liquid chamber and the second liquid chamber: a liquid level sensor; and a controller. The controller may be configured to: receive a first discharge instruction for discharging the liquid through the head; based on the received discharge instruction, control discharging the liquid through the head; update the liquid amount V stored in the memory with a value equivalent to the amount of the liquid instructed to be discharged by the received first discharge instruction; determine whether the updated liquid amount V is equal to or larger than a threshold amount; receive a first signal output from the liquid level sensor in response to a position of a liquid level in the second liquid chamber being equal to or higher than a boundary position or a second signal output from the liquid level sensor in response to the position being lower than the boundary position, from the liquid level sensor, after discharging the liquid according to the first discharge instruction: in response to determining that the updated liquid amount V, at receiving the second signal from the liquid level sensor, is equal to or larger than the threshold amount, update the liquid amount V stored in the memory to a predetermined value; and in response to determining that the updated liquid amount V, at receiving the first signal from the liquid level sensor, is less than the threshold amount, prohibit the liquid from being discharged through the head.

According to the present disclosure, since the subsequent discharge of the liquid through the head is prohibited when the liquid amount V becomes less than the threshold amount before the signal output from the liquid level sensor changes into the second signal from the first signal, air-in can be effectively prevented even when the liquid level sensor has malfunctioned.

What is claimed is:

1. A liquid discharge apparatus comprising:

an installation case configured to receive a cartridge including a first liquid chamber in which a liquid is stored, a first flow path in which one end thereof communicates with the first liquid chamber and the other end communicates with the outside, and a second flow path in which one end thereof communicates with the first liquid chamber and the other end communicates with the outside;

a tank including:

a second liquid chamber;

a third flow path in which one end thereof communicates with the outside and the other end communicates with the second liquid chamber, at least one of the first flow path and the third flow path configured to communicate with the first chamber of the cartridge installed in the installation case and the second chamber;

a fourth flow path in which one end thereof located below the third flow path communicates with the second liquid chamber; and a fifth flow path in which one end thereof communicates with the second liquid chamber and the other end communicates with the outside;

a head that communicates with the other end of the fourth flow path;

a memory storing a liquid amount V for specifying an amount of a liquid stored in the first liquid chamber and the second liquid chamber;

a liquid level sensor; and a controller that is configured to:

receive a first discharge instruction for discharging the liquid through the head;

based on the received first discharge instruction, control discharging the liquid through the head;

update the liquid amount V stored in the memory with a value equivalent to the amount of the liquid instructed to be discharged by the received first discharge instruction;

determine whether the updated liquid amount V is equal to or larger than a threshold amount;

receive a first signal output from the liquid level sensor in response to a position of a liquid level in the second liquid chamber being equal to or higher than a boundary position, after discharging the liquid according to the first discharge instruction;

and in response to determining that the updated liquid amount V, when the first signal from the liquid level sensor is received, is less than the threshold amount, prohibit the liquid from being discharged through the head.

2. The liquid discharge apparatus according to claim 1, wherein the controller is further configured to:

receive a second signal output from the liquid level sensor in response to the position being lower than the boundary position; and in response to determining that the updated liquid amount V, when the second signal from the liquid level sensor is received, is equal to or larger than the threshold amount, update the liquid amount V stored in the stored in the memory to a predetermined value.

3. The liquid discharge apparatus according to claim 2, wherein the liquid amount V is a liquid amount Vs stored in the second liquid chamber, wherein the predetermined value is equivalent to a volume of a part of the second liquid chamber located below the boundary position, and wherein the threshold amount is less than the predetermined value.

4. The liquid discharge apparatus according to claim 3, wherein the controller is configured to:

after updating the liquid amount V to the predetermined value, receive a second discharge instruction for discharging a liquid through the head;

based on the received second discharge instruction, control discharging the liquid through the head;

update a count value to be closer to a threshold with a value equivalent to the amount of the liquid instructed to be discharged by the received second discharge instruction;

determine whether the count value reaches the threshold; and prohibit the liquid from being discharged through the head in response to determining that the count value reaches the threshold.

5. The liquid discharge apparatus according to claim 3, further comprising:

a display, wherein the controller is configured to display information related to the liquid amount Vs on the display.

6. The liquid discharge apparatus according to claim 3, wherein the liquid amount V further includes a liquid amount Vc stored in the first liquid chamber, and the controller is configured to:

determine a discharge amount Dh of the liquid indicated in the first discharge instruction;

based on the determined discharge amount Dh, determine an outflow amount Qa indicating amount of the liquid flowed out from the fourth flow path toward the head for a time period Δt during which the liquid is discharged through the head;

based on the determined outflow amount Qa, a flow path resistance Rc of the second flow path, a flow path resistance Rs of the fifth flow path, and a flow path resistance Rn, determine an outflow amount Qc of the liquid flowing from the first liquid chamber to the second liquid chamber for the time period Δt during which the liquid is discharged through the head, the flow path resistance Rn being a resistance of at least one of the first flow path and the third flow path;

read out the liquid amount Vc and the liquid amount Vs from the memory;

subtract the outflow amount Qc from the read liquid amount Vc to determine the liquid amount Vc after a lapse of the time period Δt;

subtract the outflow amount Qa from the read liquid amount Vs and adds the outflow amount Qc to determine the liquid amount Vs after the lapse of the time period Δt; and store the determined liquid amount Vs and the determined liquid amount Vc in the memory.

7. The liquid discharge apparatus according to claim 6, wherein a part of the first liquid chamber overlaps with a part of the second liquid chamber as seen in a horizontal direction in a state where the cartridge is installed in the installation case, and wherein the controller is configured to determine the outflow amount Qc that increases as a difference between a height Hc from a reference position to a liquid level of the first liquid chamber and a height Hs from the reference position to the liquid level of the second liquid chamber becomes larger.

8. The liquid discharge apparatus according to claim 6 further comprising:

an interface, wherein the cartridge includes a cartridge memory, and wherein the controller is configured to:

determine whether the cartridge is installed in the installation case;

in response to determining that the cartridge is installed in the installation case, read out the liquid amount Vc from the cartridge memory of the cartridge through the interface; and store the read liquid amount Vc in the memory.

9. The liquid discharge apparatus according to claim 6, wherein the controller is configured to:

stand by from the time point at which the liquid amount Vc and the liquid amount V are stored in the memory until the time period Δt elapses; and in response to the time period Δt being elapsed, redetermine the outflow amount Qa, the outflow amount Qc, the liquid amount Vc and the liquid amount Vs; and store the determined liquid amount Vs and the determined liquid amount Vc in the memory.

10. The liquid discharge apparatus according to claim 9, wherein the controller is configured to:

in response to storing the liquid amount Vc and the liquid amount Vs in the memory, determine whether the difference between a height Hc from a reference position to a liquid level of the first liquid chamber and a height Hs from the reference position to a liquid level of the second liquid chamber is less than a threshold height; and in response to determining that the difference between the height Hc and the height Hs is equal to or more than the threshold height, stand by until the time period Δt elapses.

11. The liquid discharge apparatus according to claim 10, wherein the controller is configured to:

in response to determining that the difference between the height Hc and the height Hs is less than the threshold height, stop the determination of the outflow amount Qa, the outflow amount Qc, the liquid amount Vc and the liquid amount Vs and stop the storing of the determined liquid amount Vc and the determined liquid amount Vs in the memory.

12. The liquid discharge apparatus according to claim 10, wherein the controller is configured to:

as the difference between the height Hc and the height Hs comes close to the threshold height, lengthen the time period Δt.

13. The liquid discharge apparatus according to claim 1, wherein the boundary position is a position that is equal to or lower than an imaginary line extending a horizontal direction through the one of the first flow path and the third flow path, in a state of being installed in the installation case.

14. The liquid discharge apparatus according to claim 2, wherein the liquid amount V includes a liquid amount Vc stored in the first liquid chamber and a liquid amount Vs stored in the second liquid chamber, wherein the threshold amount indicates a change amount of the liquid amount Vs after the liquid amount Vc becomes 0, and wherein the predetermined value is equivalent to a volume of a part of the second liquid chamber located below the boundary position.

15. The liquid discharge apparatus according to claim 1, wherein the liquid amount V is a total amount of liquid stored in the first liquid chamber and the second liquid chamber, and wherein the threshold amount is 0.

* * * * *